US006902121B2

(12) United States Patent
Kawano et al.

(10) Patent No.: US 6,902,121 B2
(45) Date of Patent: Jun. 7, 2005

(54) IMMERSION NOZZLE EXCHANGING APPARATUS AND IMMERSION NOZZLE AND CLOSING FIRE PLATE USED FOR SAME

(75) Inventors: Yasuo Kawano, Kitakyushu (JP); Nobuyuki Yokoi, Kitakyushu (JP); Junichi Funato, Kitakyushu (JP); Yukio Inoue, Kitakyushu (JP); Motoki Toyota, Kitakyushu (JP)

(73) Assignee: Krosaki Harima Corporation, Fukuoka (JP)

( * ) Notice: Subject to any disclaimer, the term of this patent is extended or adjusted under 35 U.S.C. 154(b) by 254 days.

(21) Appl. No.: 10/168,763

(22) PCT Filed: May 21, 2001

(86) PCT No.: PCT/JP01/04241

§ 371 (c)(1),
(2), (4) Date: Aug. 1, 2002

(87) PCT Pub. No.: WO02/094476

PCT Pub. Date: Nov. 28, 2002

(65) Prior Publication Data

US 2003/0029892 A1 Feb. 13, 2003

(51) Int. Cl.[7] ..... A62C 31/02
(52) U.S. Cl. ..... 239/390; 239/600
(58) Field of Search ..... 239/390, 391, 239/395, 397, 600

(56) References Cited

U.S. PATENT DOCUMENTS 4,456,157 A * 6/1984 de Jong ..... 222/591
5,190,224 A * 3/1993 Hamilton ..... 239/600
5,360,147 A * 11/1994 Aoki et al. ..... 222/600
6,568,571 B2 * 5/2003 Ando et al. ..... 222/606

FOREIGN PATENT DOCUMENTS

| | | |
|---|---|---|
| EP | 0835706 | 9/1997 |
| JP | 61-056768 | 3/1986 |
| JP | 3009112 | 1/1995 |
| JP | 10-099947 | 4/1998 |
| JP | 2001-150108 | 6/2001 |

* cited by examiner

*Primary Examiner*—Christopher Kim
(74) *Attorney, Agent, or Firm*—Jordan and Hamburg LLP

(57) ABSTRACT

In an immersion nozzle exchanging apparatus for supporting an immersion nozzle at a flange underside thereof by a plurality of key plates parallel provided on both sides to horizontally pushing out and exchange an immersion nozzle much used with a new immersion nozzle, in order to secure high realability in the joint surface at between the immersion nozzle and the refractory positioned above thereof, the immersion nozzle exchanging apparatus comprises urge pressure providing mechanisms independent of each key plate for continuously changing a deflection amount of a spring body thereof depending on a moving position of the immersion nozzle upon exchanging the immersion nozzle and at the same time changing an immersion nozzle urging force caused on the respective key plates, and a slide frame having a spring body supporting seat surface formed with a taper surface in part thereof. The immersion nozzle to be used therein has a concave surface for holding a seal member having a depth of 1.0–10 mm in a joint surface central region. A closing fire plate has a thickness greater than a flange thickness of the immersion nozzle and a difference in thickness of at least 12 mm. Also, a closing fire plate upper surface has both ends perpendicular to a push-out direction recessed over at least a width of 10 mm and a depth of 12 mm.

5 Claims, 20 Drawing Sheets

(a)

(b)

(c)

IMMERSION NOZZLE EXCHANGING APPARATUS AND IMMERSION NOZZLE AND CLOSING FIRE PLATE USED FOR SAME

TECHNICAL FIELD

The present invention relates to an apparatus for urging and holding an immersion nozzle used in continuous casting of molten metal onto a junction surface of a refractory positioned above thereof and exchanging the immersion nozzle without encountering troubles in casting operation, and to an immersion nozzle and closing fire plate to be used in the same.

BACKGROUND OF THE INVENTION

Conventionally, in pouring and casting molten metal, the immersion nozzle has been used for the purposes of preventing molten-metal oxidation, nonmetallic-inclusion involvement and occurrence of turbulent flow and splash. The immersion nozzle, because of use under severe conditions that its bore contacts flowing molten metal and the outer surface borders on the ambient air, frequently suffers damages of erosion, fracture or breakage. Meanwhile, the alumina or the like in molten steel adheres and deposits on a bore wall of the immersion nozzle to thereby narrow the molten-steel passage. In a conspicuous case, this causes clogging to forcibly interrupt casting operation. For this reason, where casting is scheduled long in time, it is required to exchange the immersion nozzle in the course of casting. The general exchange method of an immersion nozzle includes, for example, removing the old immersion nozzle in a state that casting is once suspended and the tundish is raised to set up a new immersion nozzle, thereafter resuming the casting.

However, recently there is a demand for the capability of swiftly exchanging an immersion nozzle during casting for the purpose of preventing steel-quality deterioration resulting from casting interruption or troubles induced due to cast resuming. In FIG. 20 is shown, for example, an example of Japanese Utility Model Registration No. 3009112 as an apparatus for swiftly exchanging an immersion nozzle without raising the tundish during continuous casting.

In this example, the immersion nozzle 52 in use is urged upward by the key-plate rows 51 arranged on both sides thereof and held in a state being urged onto a joint surface 54 of an upper nozzle 56. When to exchange the immersion nozzle 52, a new immersion nozzle 52*a* is pushed out sideways by a pusher 58 coupled to a cylinder 57, thereby exchanging the immersion nozzle 52 in use. At this time, because the new immersion nozzle 52*a* slides while being urged onto the joint surface 54 of the upper nozzle 56, even during casting the immersion nozzle can be instantaneously exchanged without leaking molten steel.

However, in the exchanging apparatus of this example, the upper nozzle and the immersion nozzle are pressure-joined at refractory joint surfaces thereof. A gap might occur between the joint surfaces due to local wear upon exchange operation, thermal expansion during use or variation in surface accuracy caused in manufacture. The gap if occurred causes deterioration in steel quality due to air suction through the gap or a danger of leak molten steel through the gap. Generally, in the joint surface of an immersion nozzle, joining is made through a seal member for the purpose of preventing such problems and securing sufficient sealability. However, in the exchange apparatus of this example, because the new immersion nozzle slides while being urged on the upper nozzle, the seal member set in the immersion nozzle is possibly chipped off by the upper nozzle. Thus, it is impossible to apply a seal material.

In the pressure-fit supporting apparatus for an immersion nozzle introduced in JP-B-2-49184, upon exchanging an immersion nozzle a new immersion nozzle is horizontally moved with a spacing to a joint surface of the upper refractory and, in a predetermined position, vertically pushed up and held by pressure-joining. In this apparatus, by previously set a seal member on a joint surface of the new immersion nozzle, the seal member can be interposed between the joint surfaces of the immersion nozzle and the upper refractory. However, in this apparatus, the immersion nozzle is supported by a pressure-joined support part of a metal-frame integrated structure to have a structure that, upon exchange, the immersion nozzle much used is first released of pressure-joining force and lowered downward. For this reason, there is a concern on the problems that, where the apparatus is used to exchange an immersion nozzle in casting, steel leaks from the upper refractory or impossible removal of solidified metal suspended around the nozzle bore. Namely, if solidified metal remains around the upper nozzle bore, a gap occurs at a joint surface to a new immersion nozzle or heavy damage is caused in the joint surface. Even in the presence of a seal member, its function is impeded and hence sufficient sealability is made impossible to obtain.

Furthermore, in JP-A-10-99947, in an apparatus for exchanging an immersion nozzle much used by pushing out with a new immersion nozzle, the new immersion nozzle horizontally moves with a spacing to a joint surface of the upper nozzle positioned above until coming to a predetermined position, and is pressure-joined at the predetermined position. Consequently, a seal member can be used. However, in this apparatus, because the loading of pressure-joining force to the immersion nozzle is only at left-and-right one point in a side surface center of the immersion nozzle and the immersion nozzle during parallel movement is ready to incline due to the resistance to or floating force by molten steel, the pressure-joining force is not easily applied evenly onto the entire seal member on the immersion-nozzle joint surface. Thus, there has been a problem of impediment to sealability.

DISCLOSURE OF THE INVENTION

The problem to be solved in the present invention is to provide, in an immersion nozzle exchanging apparatus for swiftly exchanging an immersion nozzle during casting, a mechanism making possible to use a seal member to a junction surface, prevent steel leak from an upper nozzle and cut the deposit or metal formed around a nozzle bore, which is further made in an apparatus structure capable of evenly loading a pressure-joined force to the entire junction surface, thereby securing a higher sealability in the junction surface between the immersion nozzle and the upper refractory.

In the immersion nozzle exchanging apparatus of the invention, during casting, the immersion nozzle flange at an underside is supported by a plurality of key plates parallel provided on both sides thereof, so that an urge force is acted from the key plates to pressure-join the immersion nozzle to the upper refractory. Meanwhile, upon exchanging an immersion nozzle, in an immersion nozzle exchanging apparatus for horizontally pushing out and exchanging an immersion nozzle much used with a new immersion nozzle, the plurality of key plates for supporting the underside of the immersion nozzle flange respectively have independent urge-force providing mechanisms so that, depending on a horizontal moving position of the immersion nozzle, spring-body upper support shafts are varied in abutment height position by a spring-body supporting seat surface of a slide frame simultaneously horizontally moving having a taper surface in part thereof and a horizontal surface changed in height position in the front and rear thereof to vary a deflection amount of each individual spring body. As a result, an immersion-nozzle urging force caused on each individual key plate is varied by continuously changing a repelling force. Due to this, when exchanging an immersion nozzle, until the new immersion nozzle reaches a predetermined position, an urge force is kept to act such that the immersion nozzle much used remains in a state being urged on the upper refractory joint surface for a time as long as possible, whereby steel leak from the joint surface is prevented and the immersion nozzle much used is slid in a state of keeping the urge force thereby making possible to cut and remove the deposited metal at around the nozzle bore by the upper and lower joint surfaces.

On the other hand, the new immersion nozzle in its movement is not acted upon by an urge force from the key plates supporting the immersion nozzle but in a state of being rested on the key plates, thus moving in a manner keeping a constant space at between the immersion-nozzle joint surface and the upper-refractory joint surface. For this reason, the seal member set on the joint surface of the new immersion nozzle is prevented from falling or being damaged due to contact with the upper refractory joint surface.

Furthermore, in the immersion nozzle exchanging apparatus of the invention, a plurality of key plates are parallel arranged oppositely in the left and right with respect to a push-out direction and to act an immersion-nozzle urging force evenly at an equal interval in the push-out direction. Furthermore, in order for a new immersion nozzle to be pushed from the guide rail on the insertion side onto the key plates, the key plates are provided having taper surfaces at immersion-nozzle contact points such that the key-plate taper surface lower end when a support point of the key plates contacting the immersion nozzle is at an uppermost point is below a guide-rail slide surface while the key-plate taper surface upper end when at a lowermost point is above the guide-rail slide surface.

The immersion nozzle to be used on the immersion nozzle exchanging apparatus of the invention has, in its upper end joint surface central region, a concave surface having a depth of 1.0–10 mm to hold a seal member. Due to the presence of the concave surface, the seal member can be held without falling or deviation in its set position even if somewhat tilted during immersion-nozzle handling.

Also, in the immersion nozzle exchanging apparatus of the invention, a closing fire plate can be arranged which is to be used for emergently stopping molten-steel stream upon ending casting or due to occurrence of a certain trouble during casting. By setting the thickness of the closing fire plate greater than a thickness of the immersion-nozzle flange to have a difference therefrom of at least 12 mm, a sufficient urge-joining force can be exhibited not to leak steel through joint surfaces between upper refractory and closing fire plate thereby closing the nozzle bore thereof. Furthermore, the upper surface of the closing fire plate is featured to have both ends recessed at least in a width of 10 mm and depth of 12 mm perpendicular to the push-out direction, not to interfere with the ball plunger provided for controlling the position of the immersion nozzle.

The immersion nozzle to be exchanged in the course of casting is usually uses a jig for handling. The immersion nozzle must be fixed in direction cooperatively with the jig and firmly gripped, in order to be changed in its carriage upon removed from and attached to the exchanging apparatus and fix a direction of the molten-steel delivery port in setting properly to the apparatus.

For this reason, the immersion nozzle at its neck is covered with a metal case. Projections having a length in a metal-case circumferential direction of at least two-thirds or greater of a bore diameter of the immersion nozzle are provided horizontally and in parallel on a metal case surface in a same side as a molten steel delivery port of the immersion nozzle at two locations of a position spaced at least 95 mm below from an immersion nozzle upper end surface and a position spaced at least 50 mm below thereof, thus offering a convenience to realize secure grip with the handling jig.

BEST MODE FOR CARRYING OUT THE INVENTION

Explanations will be made on the representative embodiments of an immersion nozzle exchanging device, closing fire plate, and immersion nozzle of the present invention.

Figure 1:
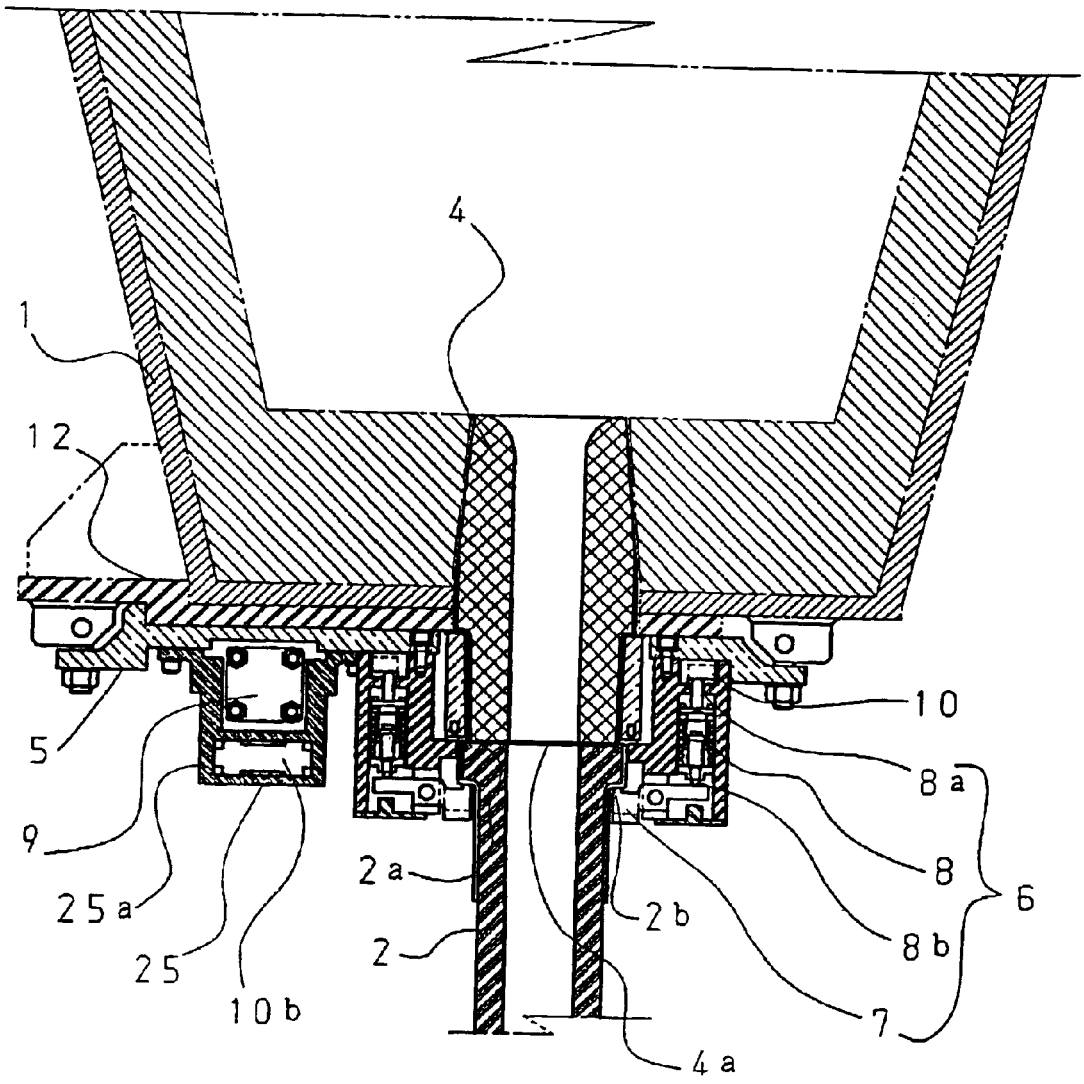
FIG. 1 shows a vertical sectional view that an immersion nozzle exchanging apparatus of the present invention is directly provided on the tundish.

In FIG. 1, in a continuous casting equipment, a base plate 12 is attached in a bottom of a tundish 1 having stopper bricks to control the flow rate of molten steel into a mold, to mount an immersion nozzle exchanging apparatus of the present invention (hereinafter, referred to as the present apparatus) onto an underside of the base plate 12. The main body part of the present apparatus is structured with a holder metal frame 5, a slide frame 10, a guide metal frame 25 and urge-force providing mechanisms 6 composing of key plates 7 for holding an immersion nozzle and providing it with an urge force, a spring bodies 8 and spring support shafts 8*a*, 8*b*. At an upper stage within the guide metal frame 25 a hydraulic cylinder 9 is provided for use in driving the slide frame 10, while at a lower stage thereof a guide projection 10*e* of the slide frame is assembled (see FIG. 2).

An upper nozzle 4 having a molten-steel discharge port is arranged in the bottom of the tundish 1. In the above, a stopper brick (not shown) is provided to control the flow rate of molten steel. In a lower end surface of the upper nozzle 4, formed is a junction surface 4*a* to the immersion nozzle 2. This figure shows an attaching state of the immersion nozzle 2 during casting. The immersion nozzle 2 has, at its upper end surface, a junction surface 2*a* to the upper nozzle 4, and supported at its flange 2*b* lower surface by the key plates 7 urged by the spring bodies 8 thus being pressure-joined onto the upper nozzle 4.

Figure 2:
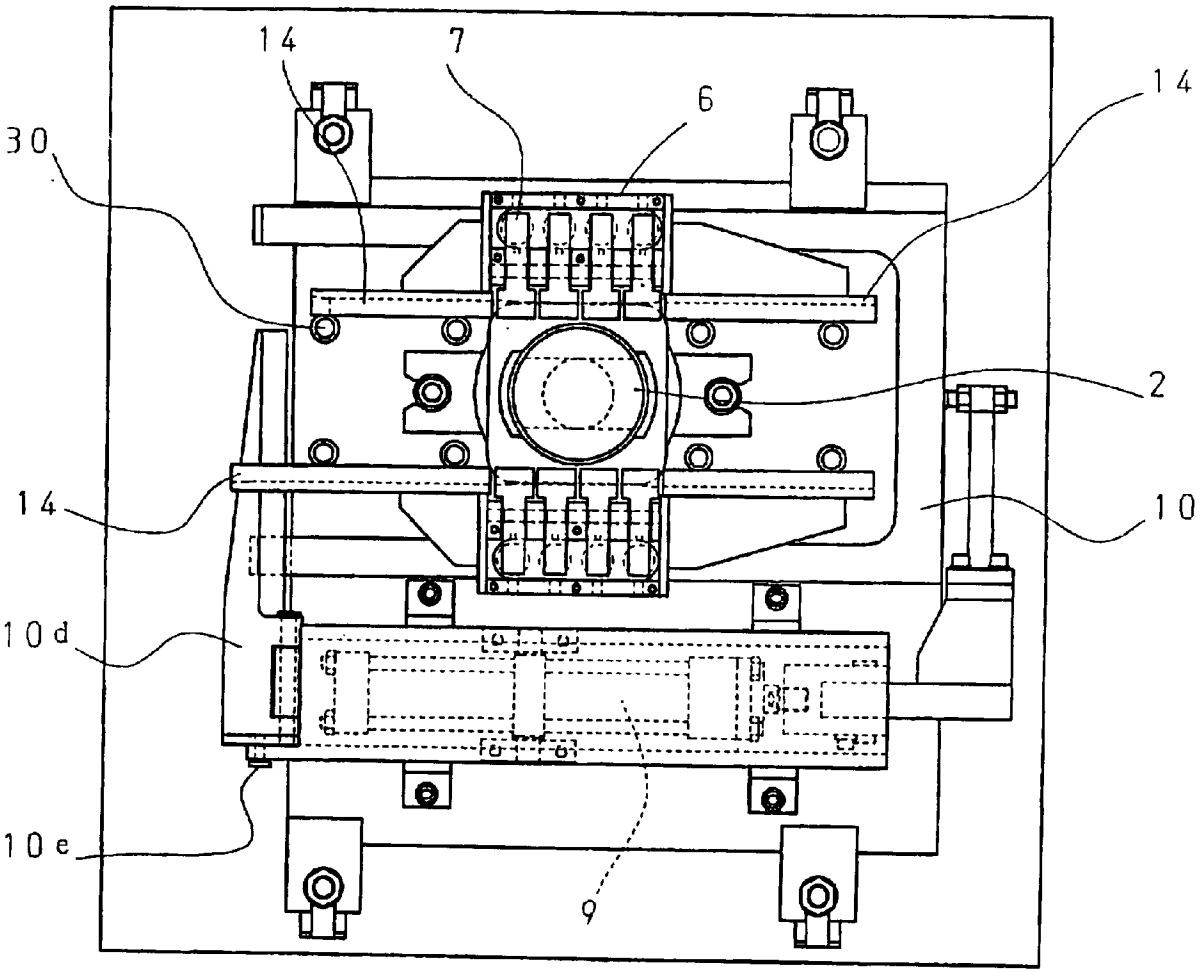
FIG. 2 shows a plan view of an immersion nozzle exchanging apparatus of the invention as viewed from the below.

FIG. 2 is a plan view of the present apparatus as viewed from the below, showing an arrangement state of the key plates 7 of among the urge-force providing mechanisms 6 on the both sides in a perpendicular direction/a right angled direction to a movement direction of the immersion nozzle 2, ball plungers 30 for controlling the carriage of the immersion nozzle 2, a slide frame 10 and a hydraulic cylinder 9 for drive the same, and a guide rail 14 for the immersion nozzle 2 prior to or after exchange to slide over and be held thereon. The key plates 7 is in a form of inserting the immersion nozzle 2. In this embodiment, they are parallel arranged oppositely four each in the left and right. Each key plate 7 individually has a spring body for urging its repelling force independently onto the key plate 7. These key plates 7 are arranged such that the urge force has a center distributed equidistantly in a slide direction of the junction surface to the upper nozzle and within an overlapping range with the junction surface of the upper nozzle. The guide rail 14 is horizontally arranged on left and right extensions of the key-plate rows. A new immersion nozzle is inserted at a position close to a side of a left pusher 10*d* in the figure. The guide rail 14 in the front (upper in the figure) as viewed from an operator is 50 mm shorter than the guide rail 14 in the deeper position (lower in the figure). This is to provide a guide role so that, when an immersion nozzle 2 is set to the guide rails 14, it can be first abutted against the longer one in the deeper position to be horizontally moved, thereby being easily set on the both guide rails 14. The guide rail 14 on the right in the figure is on the discharge side, wherein the immersion nozzle much used that have been pushed out by a new immersion nozzle is disengaged from all the key plates 7 and moved over to the guide rail 14 on the discharge side where it is recovered in this position. In the above of the guide rails on the insertion and the discharge sides, ball plungers 30 are provided four in each so that the immersion nozzle 2 on the guide rails 14 is not floated or inclined due to a float force or stirring force by molten steel. The ball plungers 30 push the immersion nozzle 2 at its upper surface according to the situation, to have also a role for smoothening the movement thereof or prevent the interference with the apparatus main body above positioned.

Figure 3:
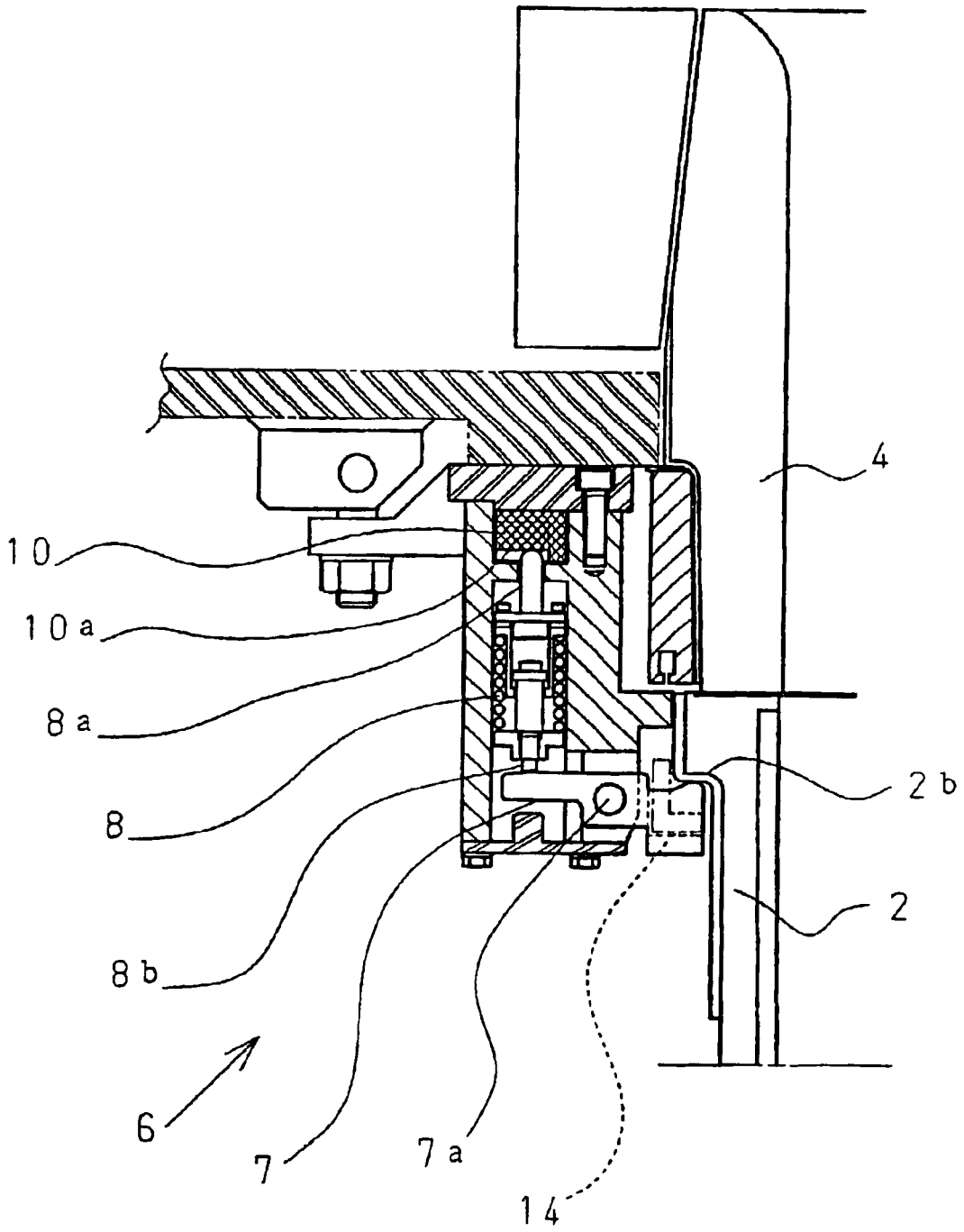
FIG. 3 shows a sectional view explaining a urge-force providing mechanism for the key plates to support the immersion nozzle and provide an urge force.

In FIG. 3 is shown a sectional view of the urge force providing mechanism 6 given by FIG. 1. The urge-force providing mechanism 6 is structured with a spring-body supporting seat surface 10*a* of the slide frame 10, a spring body 8, an upper spring support shaft 8*a*, a lower spring support shaft 8*b* and a key plate 7. The spring body 8 is clamped at its upper and lower surfaces by the spring support shafts 8*a*, 8*b*. The upper spring support shaft 8*a* on one end there has an upper end abutting against the spring body supporting seat surface 10*a* of the slide frame 10 while the lower spring support shaft 8*b* on the other end has a lower end abutting against a rear part of the key plate 7, thus restricting the free length. The both support shafts 8*a*, 8*b* are assembled for sliding clamping the spring body 8, to follow the free length change in the spring body 8. The key plate 7 at its front supports the flange 2*b* underside of the immersion nozzle 2. In the side surface, a taper surface is formed toward an immersion-nozzle moving direction in order for the immersion nozzle 2 to readily move over onto the key plate 7 during exchange of the immersion nozzle. The key plates 7 can be inclined about a key-plate shaft 7*a*. The present figure shows a state that the spring body 8 is deformed by a predetermined amount. The repelling force is exerted to the rear part of the key plate 7 to urge the front part of the key plate 7 upward thereby pressure-joining the immersion nozzle 2 onto the upper nozzle 4.

Figure 4:
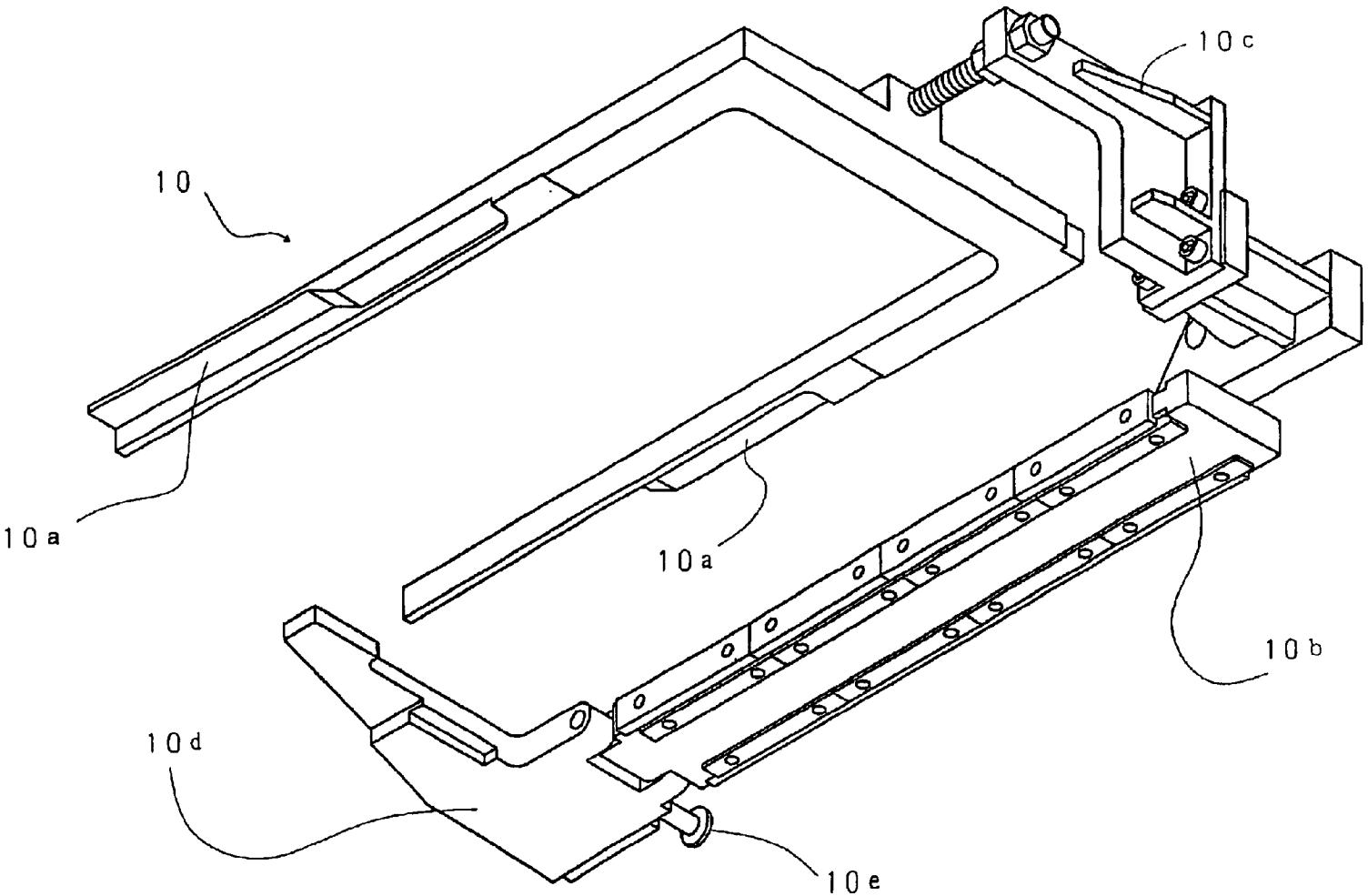
FIG. 4 shows a perspective view of a slide frame, as viewed from the below, coupled to a hydraulic cylinder and, on the other hand, to be abutted against the immersion nozzle to push and slide it.

FIG. 4 shows a slide frame 10. The slide frame 10 horizontally moves back and forth of the immersion nozzle 2 in a form that a slide guide 10*b* thereof is guided by a slide-frame slide guide wall 25*a* at an inner side of the guide metal frame 25, as shown in FIG. 1. The slide frame 10 comprises a spring body supporting seat surface 10*a* abutting against the upper spring support shaft 8*a* of the spring body 8 shown in FIG. 3, a slide guide 10*b* mentioned above, a bracket 10*c* coupled to a driving hydraulic cylinder 9 attached at the inner upper of the guide metal frame 25 shown in FIG. 1 and further coupling between the spring body supporting seat surface 10*a* and the slide guide 10*b*, and a pusher 10*d* abutting against the immersion nozzle flange side surface to push out the immersion nozzle. The pusher 10*d* is pin-coupled to the slide frame main body to be kept in a rotatable position such that it avoids upward when a new immersion nozzle is set onto the guide rail 14 and abuts against the flange of an immersion nozzle after setting the immersion nozzle. The pusher 10*d* is made in a mechanism to be guided at a guide projection 10*e* along a guide groove 25*b* of the guide metal frame (see FIG. 5), automatically rotate depending on a slide position of the slide frame 10 and keep a horizontal position, thereby moving the immersion nozzle. The spring body supporting seat surface 10*a* forms a taper surface continuing to the horizontal surface between horizontal surfaces having a height, to vary the height direction position at the upper end of the upper spring support shaft 8*a* abutting against the spring body supporting seat surface 10*a* depending on movement of the slide frame 10 (pusher 10*d*), thus having a role to release and increase/decrease the load of a compression force on the spring body 8 in relation to the inclination in the key plate 7 abutted against by the lower end of the lower spring support shaft 8*b*. In a state that the upper spring support shaft 8*a* abuts against the spring body supporting seat surface 10*a* positioned vertically high, usually the spring body 8 is released in compression force, while, in a state abutting against it in a low position, the spring body 8 is loaded with a compression force. In the taper surface, the upper spring support shaft 8*a* in its abutment position varies in a height direction with movement of the slide frame 10, gradually increasing or decreasing the compression force of the spring body 8.

FIG. 5 to FIG. 10 explain the procedure of immersion-nozzle exchange operation in each movement situation of the immersion nozzle. In each figure at the lower, there are shown the positions of new and old immersion nozzles dependent upon movement of the slide frame and, at the upper part, there are shown the loading situation of a compression force to the spring body and the position of key plate dependent on a position of the spring body supporting seat surface of the slide frame at that time.

Figure 5:
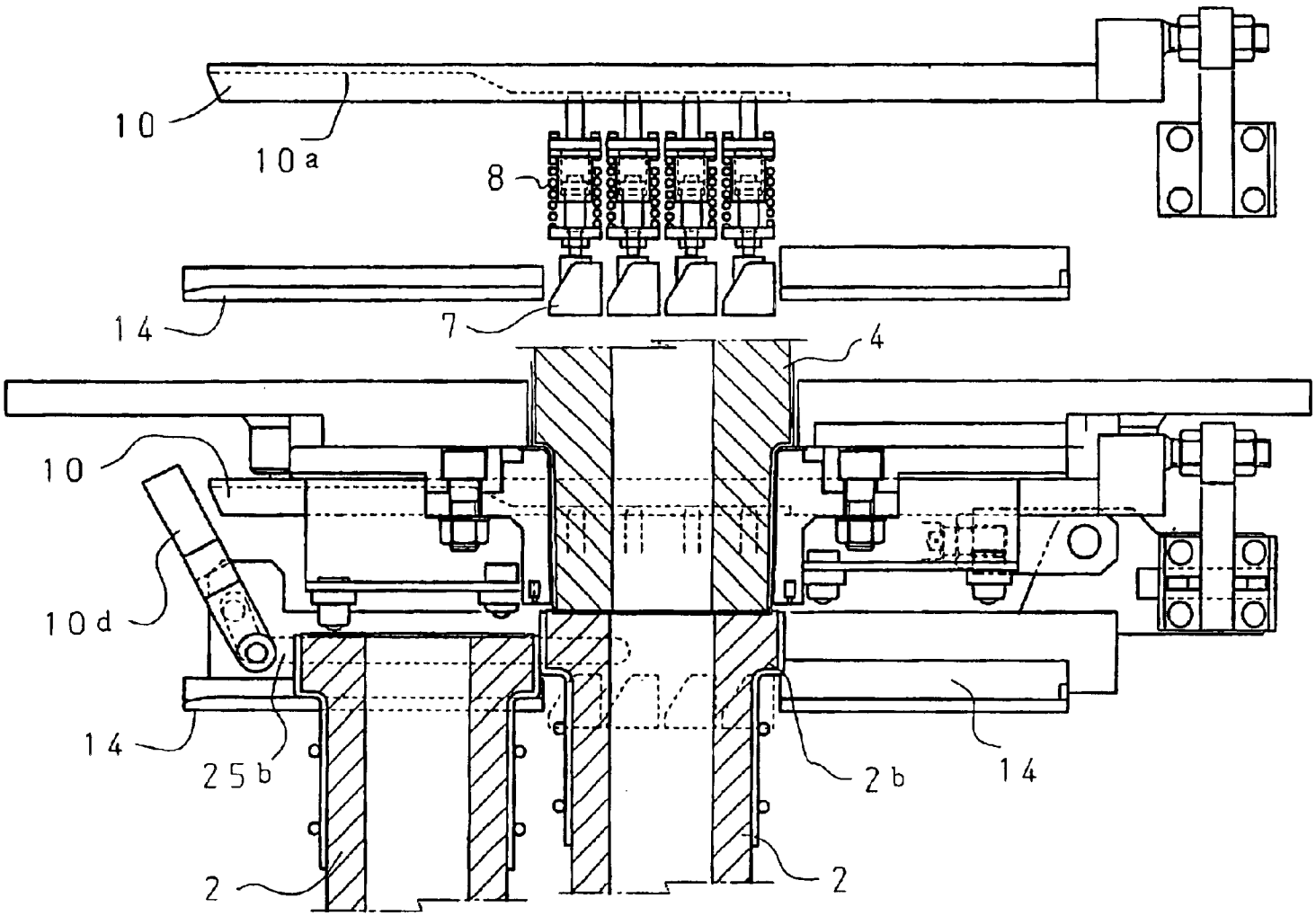
FIG. 5 to FIG. 10 are explanatory views representing, in order, immersion nozzle exchanging operations.

FIG. 5 shows a state of immediately before entering an operation that casting operation is temporarily suspended to exchange with a new immersion nozzle. When a new immersion nozzle 2 is set onto the guide rail 14, the pusher 10*d* has been rotated to the upper position and hence is free from preventing the immersion nozzle 2 from horizontally putting onto the guide rail 14 from a horizontal direction. The immersion nozzle 2 under use is acted upon by a predetermined urge force. At this time, the slide frame 10 is in a retracted limit position of the hydraulic cylinder. Accordingly, the spring body supporting seat surface 10*a* in its lower horizontal surface receives all the spring bodies 8, so that each spring body 8 is compressed by a predetermined deflection amount whereby the repelling force thereof acts upon the flange 2*b* of the immersion nozzle 2 through the key plate 7. In the present embodiment, the urge pressure by the total eight key plates is about 500 kg when the immersion nozzle 2 is closely joined to the upper nozzle 4 in a steady state.

Figure 6:
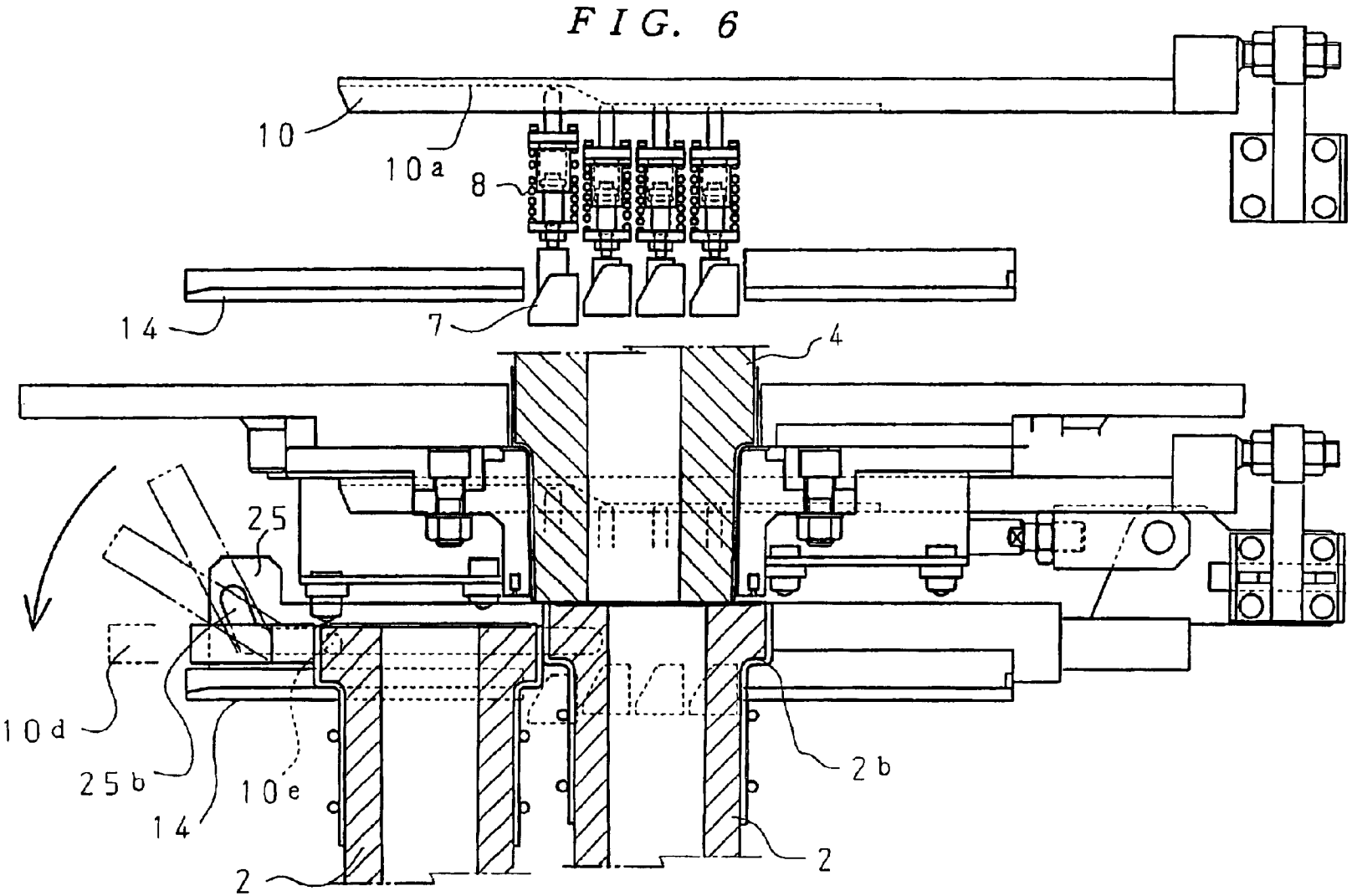
Figure 7:
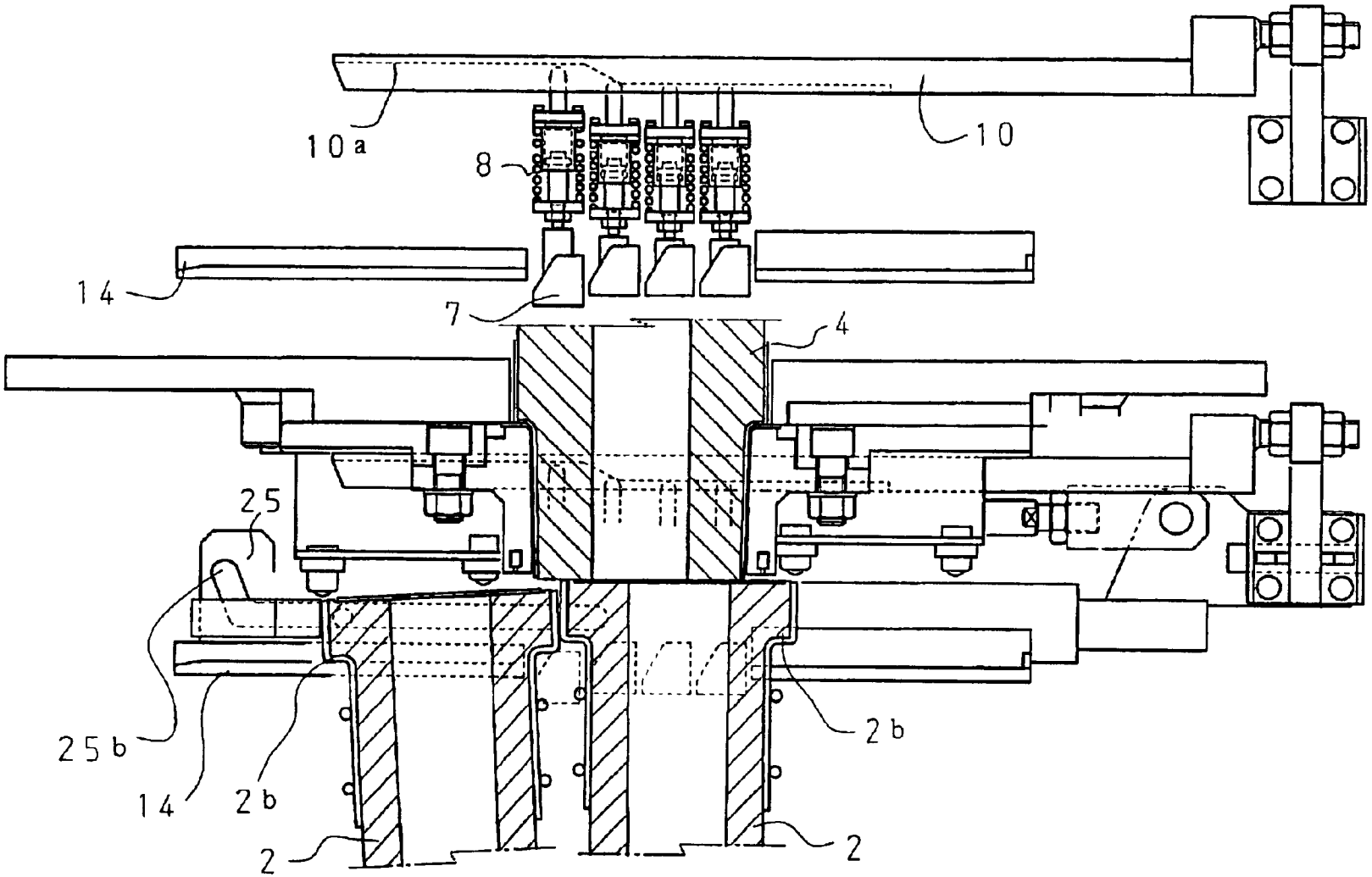

FIG. 6 and FIG. 7 show an initial state of an exchange operation. After setting a new immersion nozzle 2 on the guide rail 14, by operating the hydraulic cylinder, the slide frame 10 starts to move and the pusher 10*d* at its guide projection 10*e* is guided along the guide groove 25*b* to rotate into a horizontal position. The new immersion nozzle 2, in a state abutting against the immersion nozzle much used 2 at their flanges 2*b*, is pushed and moved in a horizontal direction by the pusher 10*d*. When the new immersion nozzle 2 comes to a position of the key plate 7 in the extreme front, the flange 2*b* at a front side-surface lower corner hits a taper surface of the key plate 7 to move up on the taper surface into a state that the flange 2*b* at its underside rests on the upper surface of the key plate 7. At this time, the spring body supporting seat surface 10*a* moves and the spring body 8 for the key plate 7 in the extreme front releases the compression force in the upper horizontal surface while gradually decreasing the compression force through the taper surface. Consequently, the key plate 7, while the flange 2*b* of the immersion nozzle 2 rises the taper surface of the key plate 7 into rest on the upper surface of the key plate 7, moves downward to reach a lower limit position where the compression force is released. The lower limit position, because the weight of the immersion nozzle 2 is small as compared to the repelling force caused from the elastic modulus of the spring body 8, is determined from an upper horizontal surface position of the spring body supporting seat surface 10*a* and a free length of the spring body 8. Consequently, the new immersion nozzle 2 is pushed forward in a lower position as compared to a support position of the immersion nozzle much used 2, thus being allowed to move to a predetermined position while keeping a constant space to the junction surface with the upper nozzle 4 positioned in the above. Accordingly, a seal member set on the junction surface of the new immersion nozzle 2 is held on the immersion nozzle 2 remaining in a set state without contacting the upper nozzle 4 during movement of the immersion nozzle. Also, in this state, the immersion nozzle much used is applied by an urge force by the six key plates and hence kept in sealability with the junction surface of the upper nozzle 4.

Figure 8:
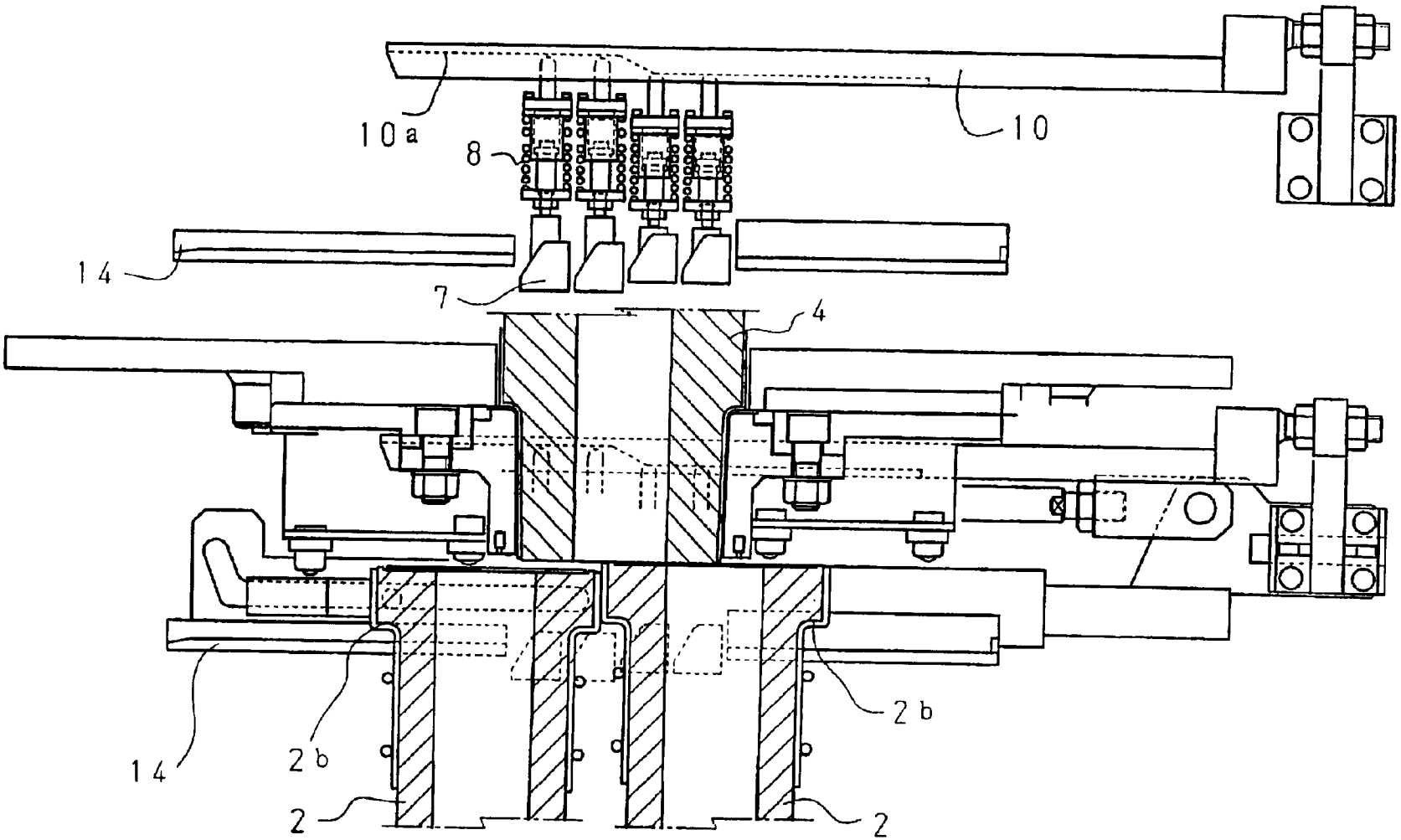

FIG. 8 shows a state that the immersion nozzle in the course of exchange operation has moved an amount of its inner bore. By the horizontal movement of the immersion nozzle much used 2 kept urged to the upper nozzle 4 with a sufficient drive force of the hydraulic cylinder, the adhered deposit substance of metal or alumina formed in a pipe form over the nozzle-bore inner wall of the upper nozzle 4 and immersion nozzle 2 during casting must be cut. Namely, the immersion nozzle 2 requires a vertical urge force and horizontal drive force sufficient for not separating at the joint surface to the upper nozzle 4 during movement and cutting the pipe clearly in a horizontal plane. In this case, in order to secure a sufficient urge force, the immersion nozzle 2 must be supported by a sufficient number of key plates 7 and urged onto the upper nozzle until the remaining substance of pipe-formed metal, deposition or the like has been cut. In the present embodiment, the key plates 7 are arranged so that the remaining substance can be ended in cutting at a time that the compression force is released from a half number, or two, of among the key plates 7 arranged symmetrically four each in the left and right on the flange 2*b* of the immersion nozzle 2. Conversely, the spring bodies 8 used in this embodiment have been selected to have an elastic modulus capable of exhibiting a sufficient urge force by a half in the number, i.e. four. In this embodiment, although the compression force is loaded or released by a height difference between the taper surfaces of the spring body supporting seat surface 10*a*, there is a need to apply a required amount of urge force to the junction surface between the upper nozzle 4 and the immersion nozzle 2 for a time as long as possible of up to the immediately before release of the compression force. Furthermore, there is a need to design the apparatus as compact as possible. For this reason, there is a necessity to select spring bodies having such a property that the compression force can be loaded or released by a small height difference in the spring body supporting seat surface 10*a* and high repelling force exhibited by a small compression amount. From this reason, it is preferred for the urge force providing mechanism of the immersion nozzle exchanging apparatus of the invention to use a coil spring as a spring body in view of heat-resisting material, durability and stability in repelling force. In this coil spring, there is a need to select one having great compression force relative to its deflection amount, i.e. great in elastic modulus. However, it is further preferred to previously preset mechanically a predetermined deflection amount from the problem of its size and space restriction as well as the necessity to exhibit a sufficient repelling force for urge the immersion nozzle much used onto the upper-nozzle junction surface to a time immediately before returning to an original length/an initial length/a pre-setted length losing the repelling force.

Figure 9:
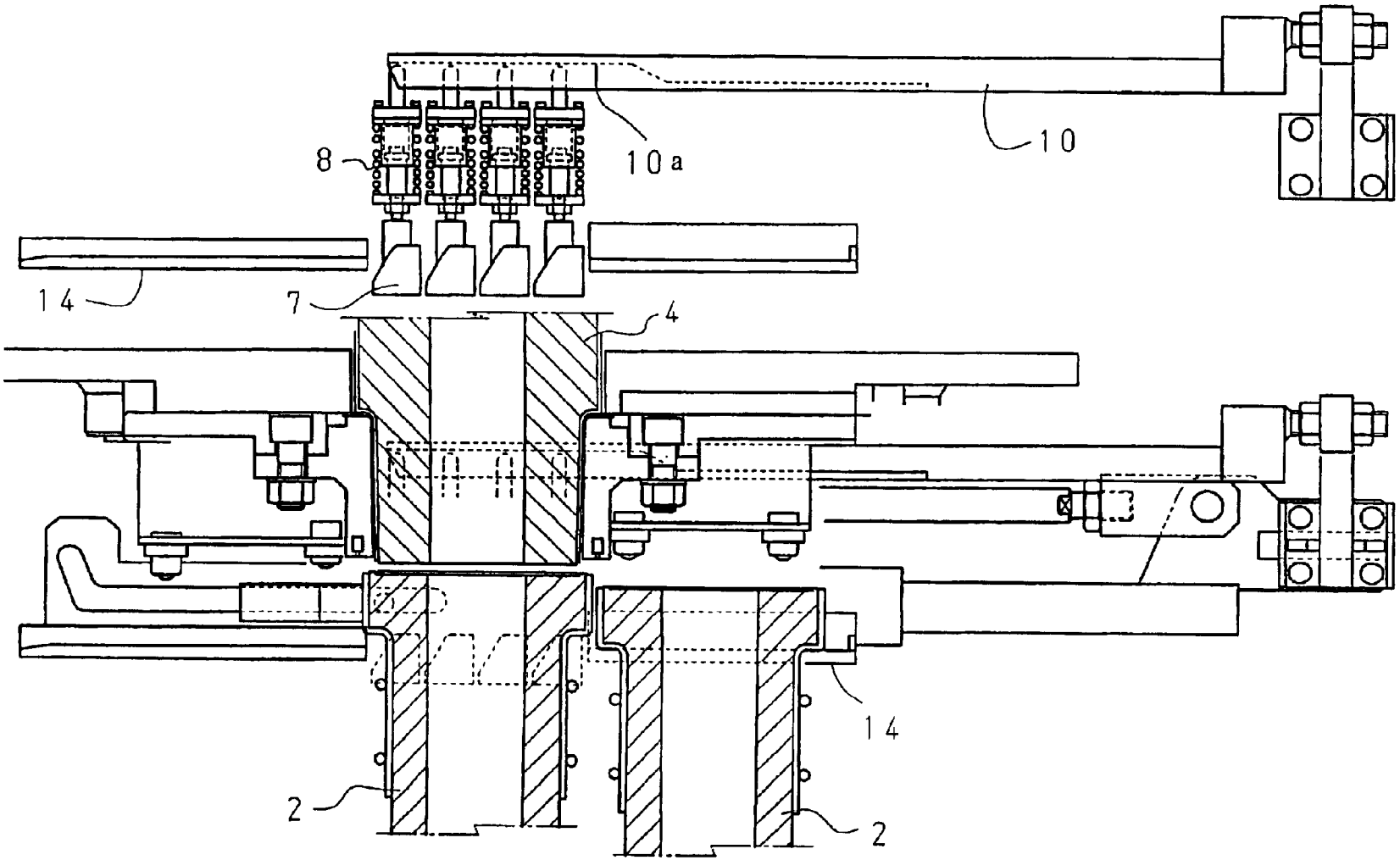

In FIG. 9, the immersion nozzle much used 2 is pushed out and moved onto the guide rail 14 while the new immersion nozzle 2 in a predetermined position of immediately beneath the upper nozzle 4 is supported by all the key plates 7. In this state, the spring bodies 8 of the key plates 7 are received by the upper horizontal surface of the spring body supporting seat surface 10*a* wherein no compression force is added. Consequently, it is supported at a key-plate position determined by a free length of the preset spring body 8. The immersion nozzle 2 has, in the above, a predetermined space to the junction surface of the upper nozzle 4. A set seal member is held as it is. At this time, the hydraulic cylinder for moving the immersion nozzle is in a forward limit. The immersion nozzle much used 2, when pushed out of the upper nozzle, is applied at a rear end with an urge force to a time immediately before separation, and at the junction surface moves onto the guide rail 14 in such an action as gradually leaving the front surface while sliding on the junction surface of the upper nozzle 4. The seal member set on the junction surface of the immersion nozzle much used 2 is successfully stripped off the junction surface of the upper nozzle 4.

Figure 10:
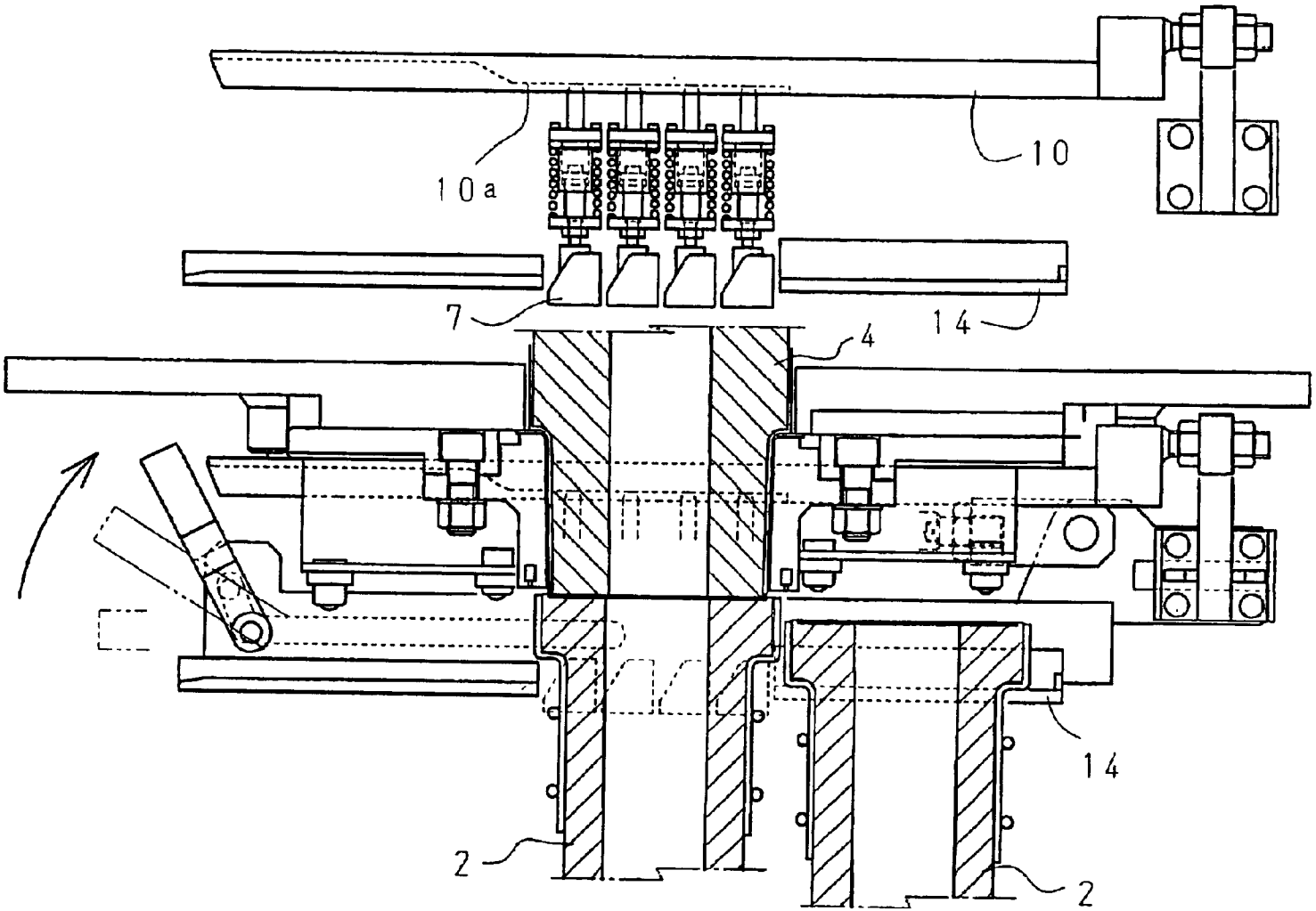

FIG. 10 shows a state that the new immersion nozzle 2 is in pressure-joined with the upper nozzle 4 through the seal member. The new immersion nozzle 2, at a forward limit position of the hydraulic cylinder, comes to a position immediately beneath the upper nozzle 4. If the hydraulic cylinder is retracted from this state, the spring body support seat surface 10*a* of the slide frame 10 abutting against the upper support shafts 8*a* of the spring bodies 8 of the key plates 7, as shifted from the upper horizontal surface through the taper surface to the lower surface, compresses the spring bodies 8 to cause their repelling force to react. At the retracted limit of the hydraulic cylinder, the spring bodies 8 on all the key plates 7 are received by the lower horizontal surface of the spring body supporting seat surface 10*a* wherein a predetermined repelling force is applied to the key plate 7 to thereby lift the immersion nozzle 2 and pressure-join it to the junction surface of the upper nozzle 4 through the seal member.

Thereafter, the immersion nozzle much used 2 is removed from the mold and a cast operation is resumed.

Figure 11:
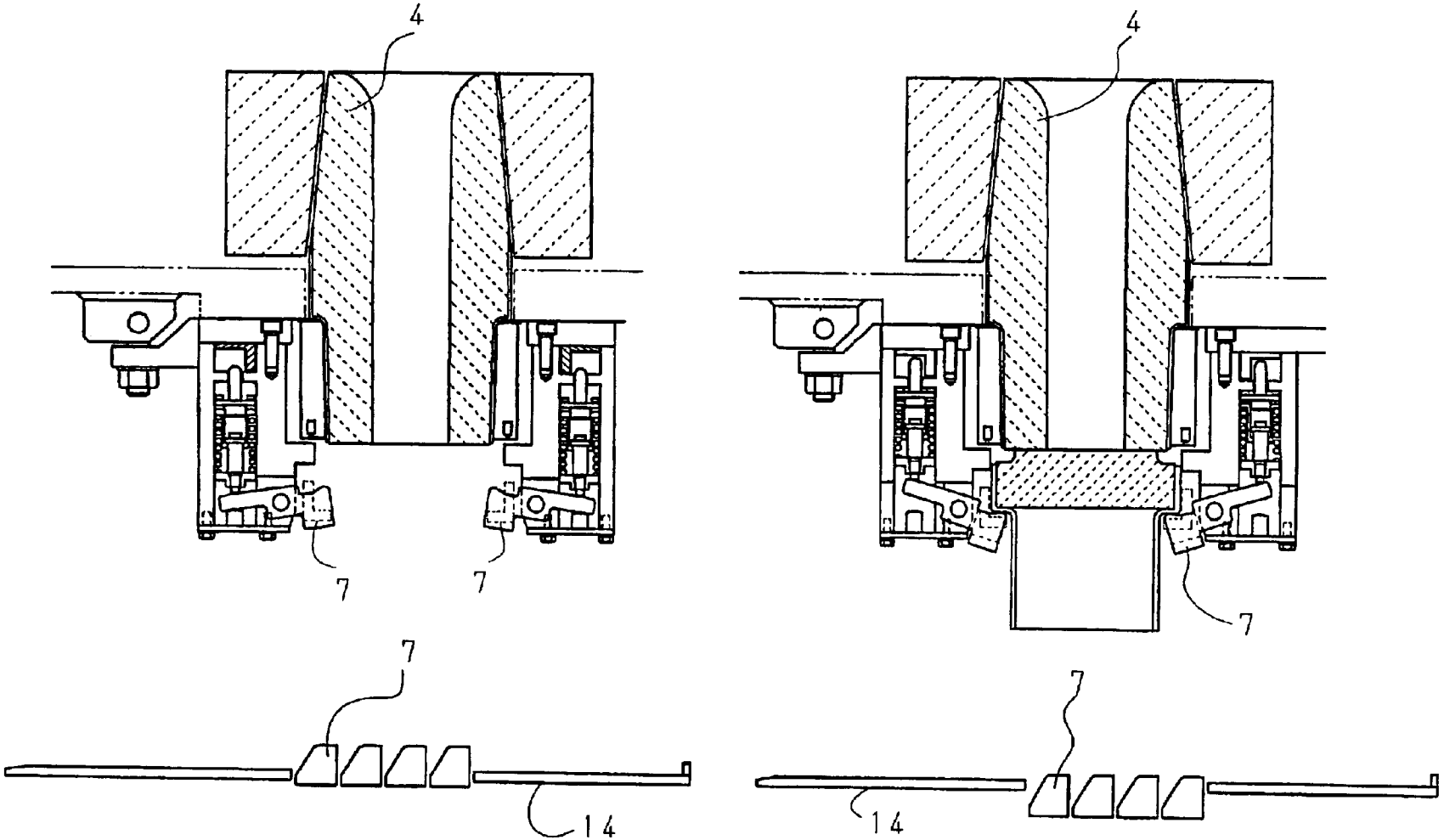
FIG. 11 shows a relationship in height-direction position between a taper surface of a key-plate tip and a guide-rail slide surface.

FIG. 11 explains the relationship between a key-plate taper surface and a guide-rail slide surface level. FIG. 11 shows, in the left, a state that nothing is set beneath the upper nozzle and, in the right, a state that a closing fire plate is set.

In an immersion nozzle exchange operation or cast shut-down operation with a closing fire plate, it is sought the immersion nozzle or closing fire plate at a tip abuts against a taper surface of the key plate 7 in the extreme front urging the immersion nozzle much used and moves up the taper surface, to rest on an upper surface of the key plate 7 and simultaneously press this key plate 7 down. As the new immersion nozzle or closing fire plate presses inward the flange of the immersion nozzle much used to move, it similarly moves for the second key plates 7 and the subsequent. For this reason, the key plates 7 of the invention have, at a tip, a taper surface with a proper gradient, thus taking consideration for making smooth the series of operations. Furthermore, the taper surface, if considering the operation of removing the closing fire plate or operation of newly setting an immersion nozzle to the exchanging apparatus, requires to be provided such that, in a lowermost position of the key plate 7 during setting with the closing fire plate, the taper-surface upper end is above a slide-surface level of the guide rail 14 (see the right in FIG. 11) or, in an uppermost position of the key plate of the key plate 7 wherein nothing is set beneath the upper nozzle 4 at a start of use of the immersion nozzle exchanging apparatus, the taper-surface lower end is below the slide-surface level (see the left in FIG. 11).

Figure 12:
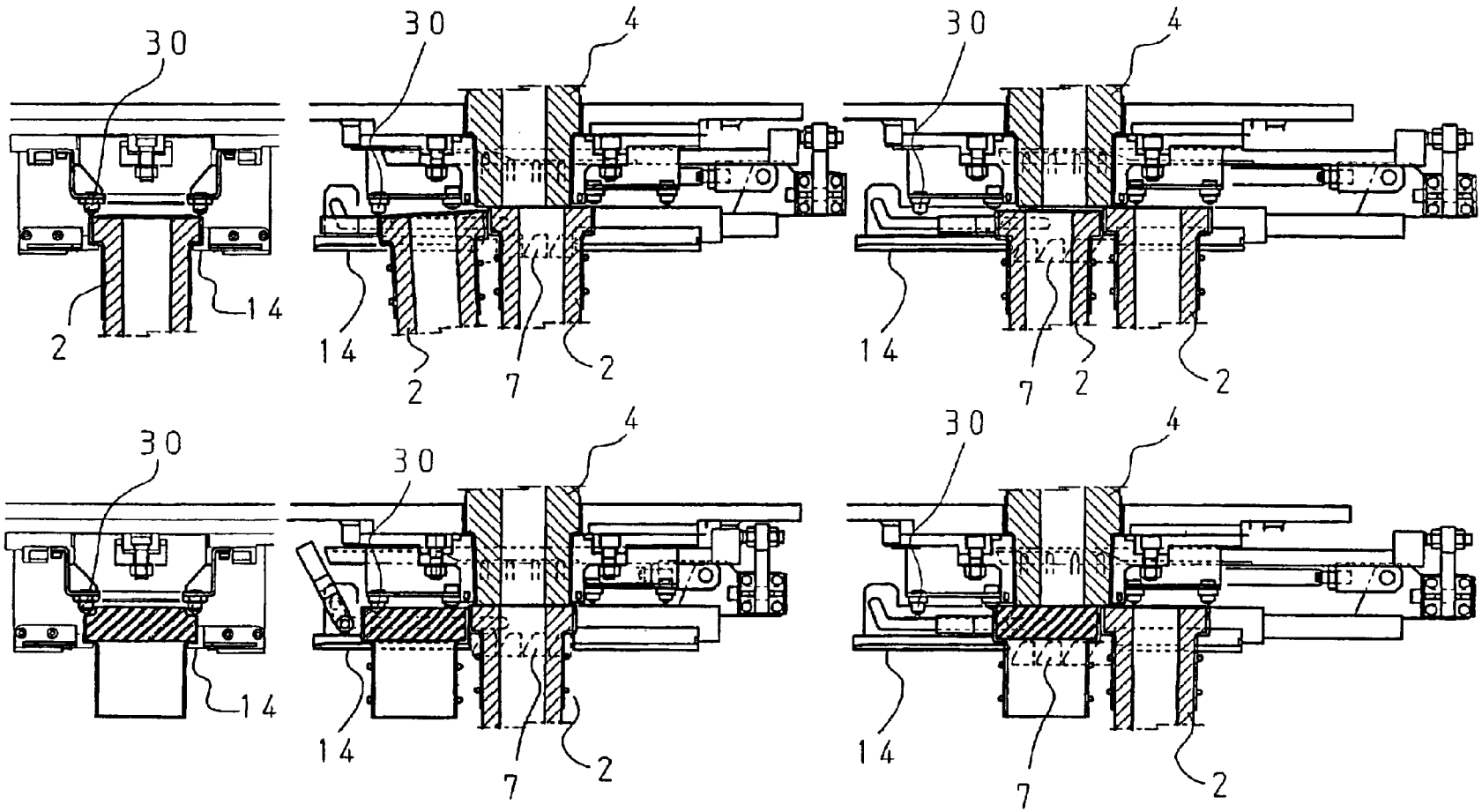
FIG. 12 shows an explanatory view of an immersion-nozzle position controlling function due to ball plungers.

FIG. 12 shows a ball plunger 30 as an elastic projection provided above an insertion position/discharge position of the immersion nozzle 2, explaining the operation to control the carriage of the immersion nozzle 2. FIG. 12 shows, in the upper, a case of exchanging the immersion nozzle and, in the lower, a case of using a closing fire plate.

At an inserting and discharge sides of the guide rail 14, the immersion nozzle 2 on the guide rail 14 is immersed in molten steel wherein there are cases that it floats up or inclines from a floating force or stirring force due to molten steel. In the case of floating up or inclination of the immersion nozzle 2, there is a concern that, during movement of the immersion nozzle 2, caused is a trouble upon moving from the guide rail 14 to the key plates 7 or from the key plates 7 onto the guide rail 14 or interference with the upper nozzle 4. Or otherwise, there may be interference with the apparatus main body in the operation of removing the immersion nozzle much used 2 from the mold. In order to prevent such a problem, ball plungers 30 are provided each four above the insert position and discharge position of the immersion nozzle 2 to restrict the upper surface position of the immersion nozzle 2 thus giving consideration to keep a carriage as vertical as possible. In the case of using a closing fire plate as shown in the lower of FIG. 12, it must be moved keeping contact with the junction surface of the upper nozzle 4 and particularly it is sought to keep a horizontal position.

The ball plunger 30 in the insertion side are attached 10 mm higher at the deep one as compared to that in the front. This is to allow for a natural inclination upon moving of the immersion nozzle 2 from the guide rail 14 onto the key plates 7. However, it is set in such a height as not to contact the junction surface of the upper nozzle 4 due to excessive inclination. The ball plunger 30 in the discharge position is attached such that its ball positions somewhat above the junction surface of the upper nozzle 4. This is to restrict the upper limit position of the immersion nozzle 2 in order to prevent interference with the exchanging apparatus main body when the pushed-out immersion nozzle much used 2 floats, inclines or is removed. The pushed-out immersion nozzle much used 2 should be immediately removed out of the mold because of the possibility to swiftly resume cast operation.

Figure 13:
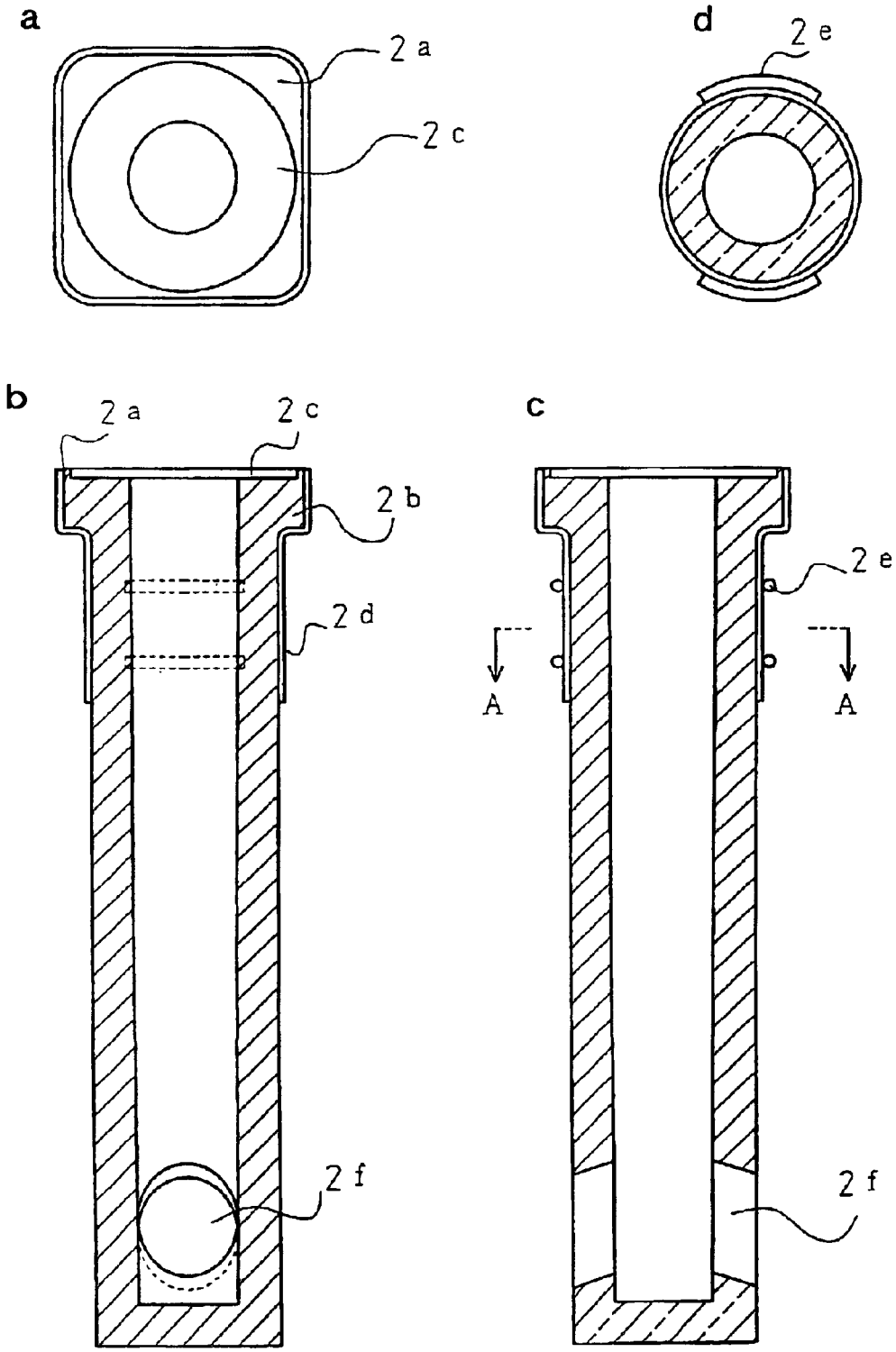
FIG. 13 shows a shape of the immersion nozzle to be applied to the immersion nozzle exchanging apparatus of the invention, wherein the same figure a is a plan view, the same figure b and c are vertical sectional views, and the same figure d is an A—A sectional view of c.
Figure 14:
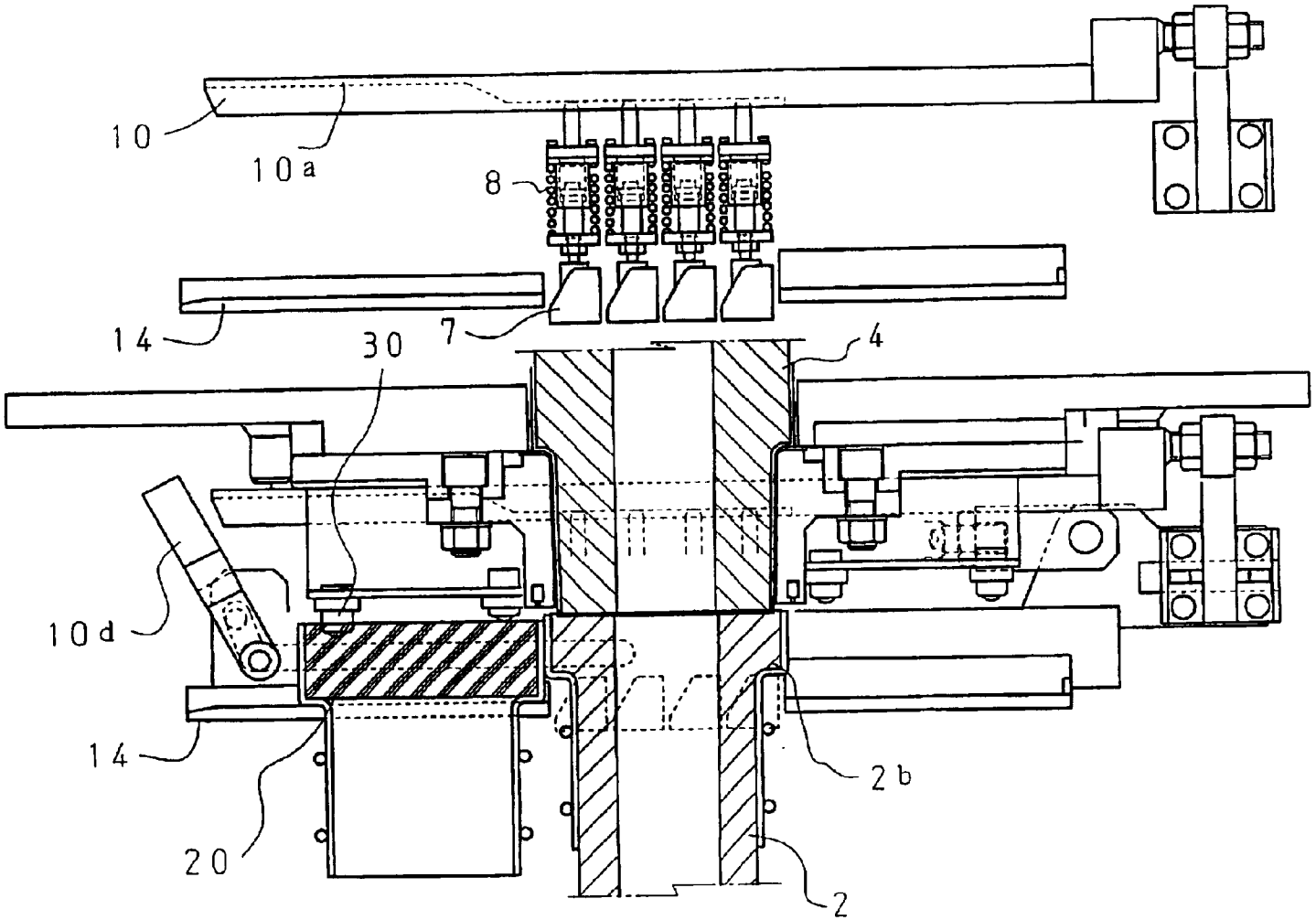
FIG. 14 to FIG. 18 are explanatory views representing, in order, operations to close the molten-steel flow-out port wherein a closing fire plate is applied to the immersion nozzle exchanging apparatus of the invention.
Figure 15:
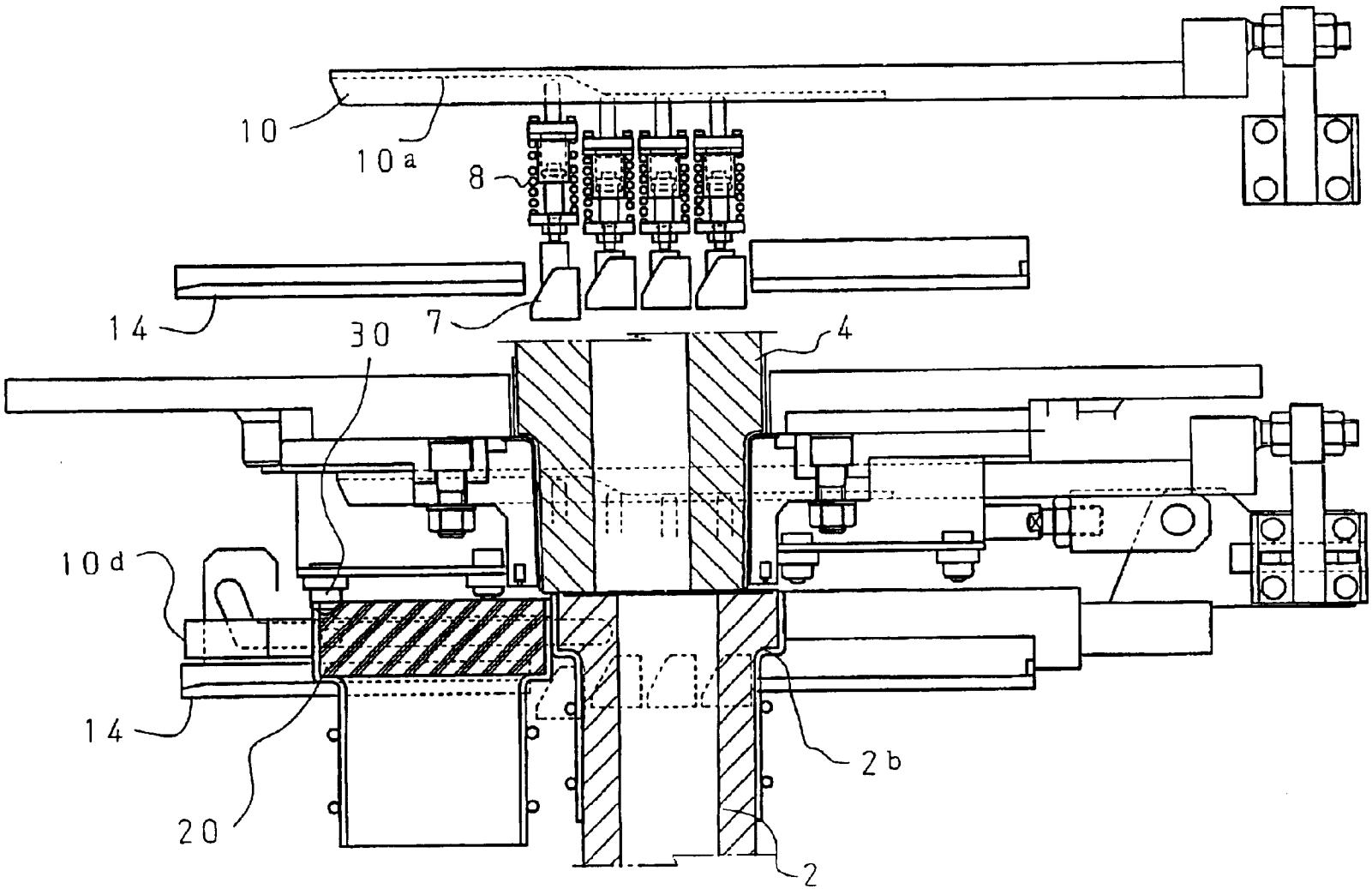
Figure 16:
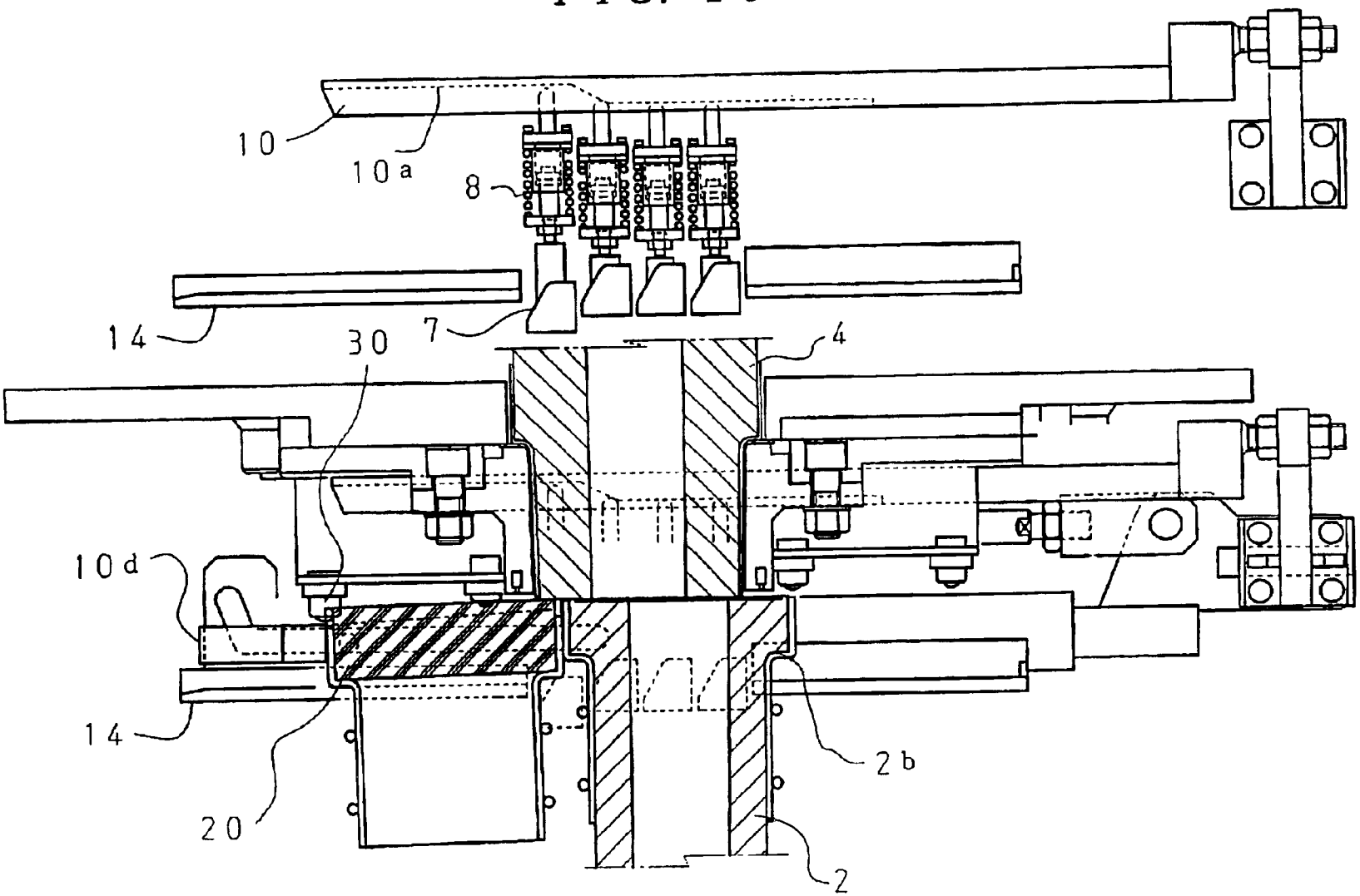
Figure 17:
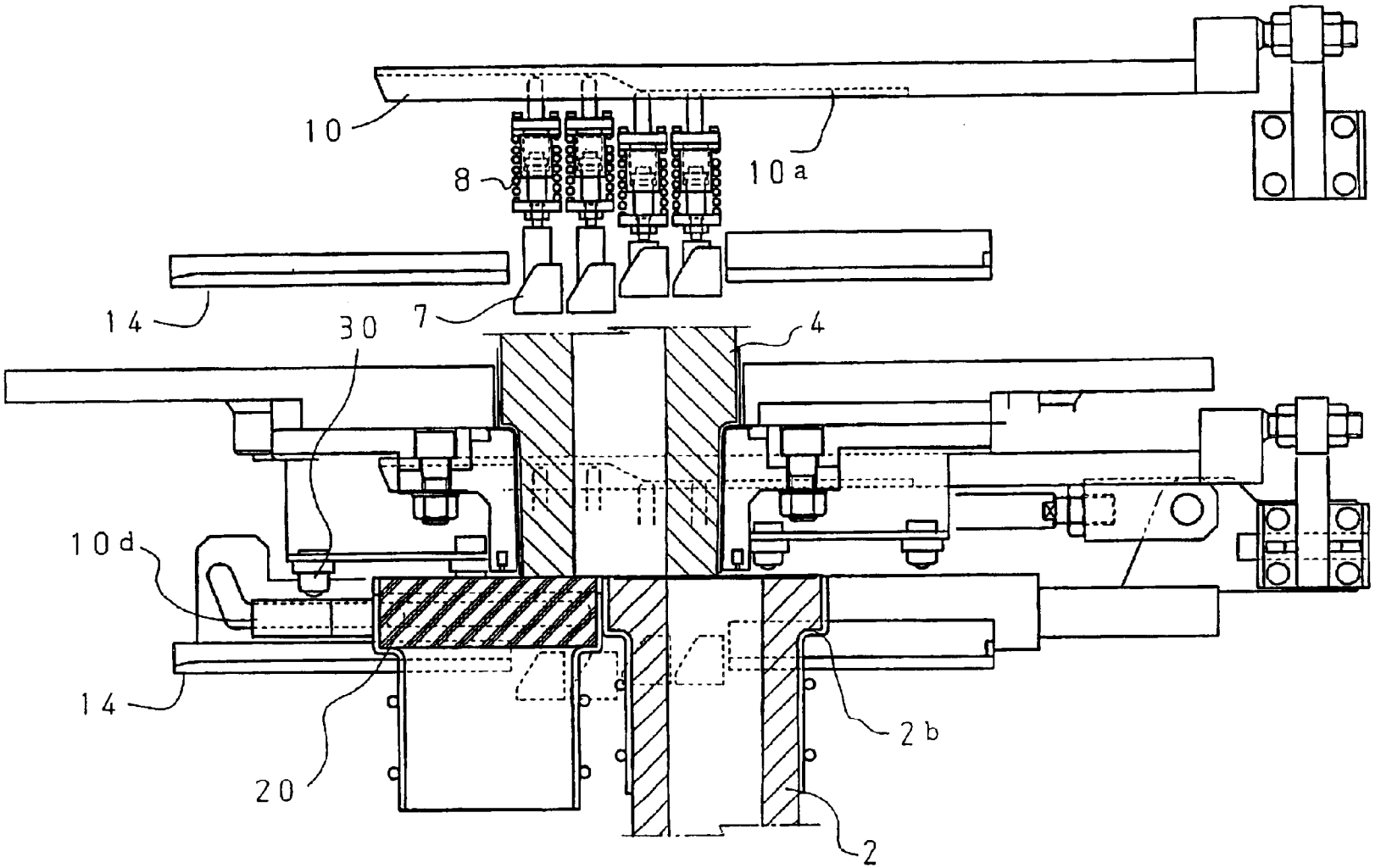
Figure 18:
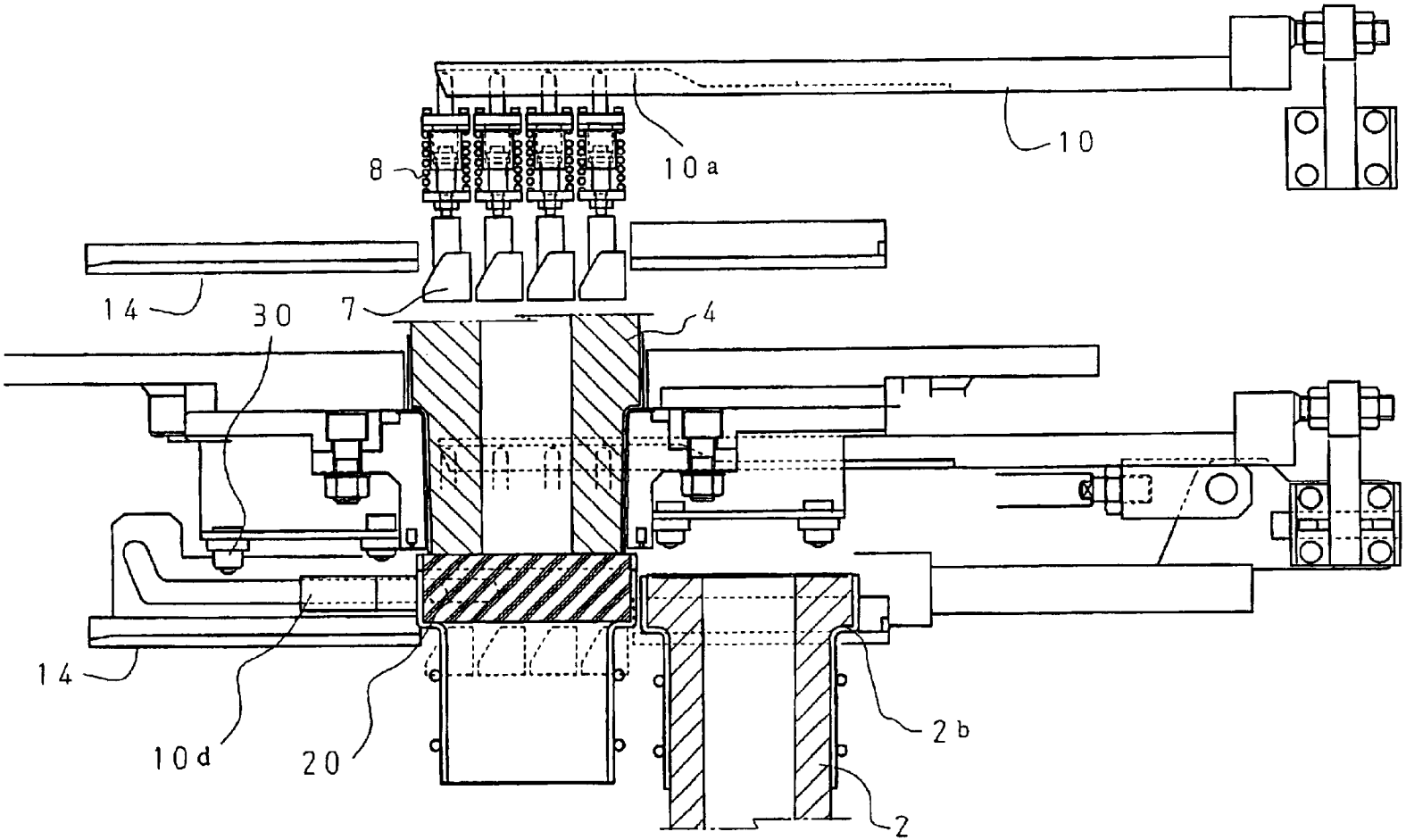

FIG. 13 shows an immersion nozzle used in the immersion nozzle exchanging apparatus.

This immersion nozzle 2 has a flange 2*b* formed in its upper part. The flange 2*b* has, in an upper surface, a junction surface 2*a* to the upper nozzle that is a horizontal surface as a slide surface. Furthermore, a recess (concave surface) 2*c* for setting thereon a seal member is circularly provided about a nozzle bore core. The recess 2*c* has a depth of 1.0–10 mm to prevent a seal member from falling even if the immersion nozzle 2 is somewhat inclined. In order to prevent falling of a seal member, the recess 2*c* is preferred as deep as possible. However, due to the property of the seal member, the increase in its thickness naturally increases the compression amount for securing sealability. From apparatus mechanical restriction and spring deflection amount, the depth has a limitation to 10 mm. On the other hand, 1.0 mm is minimally required to prevent falling. The immersion nozzle 2 has a metal case 2*d* covering from the flange 2*b* to a lower part to a neck thereof. Projections 2*e* are provided in a plurality of circumferential points in an outer periphery of the metal case 2*d* in a lower part to the neck, to conveniently maintain the position of immersion nozzle upon handling the immersion nozzle 2 to set it by using, for example, a mechanical jig or remove it from the guide rail.

Explaining more concretely, where exchanging the immersion nozzle 2 in the course of cast operation, the new immersion nozzle 2 is usually pre-heated at a high temperature. Also, because the operation would be close to the mold filled with molten steel, it is a general practice to use, as a countermeasure mainly for safety, a jig for holding and handling the immersion nozzle 2. In this case, the immersion nozzle when nearing the mold is in a horizontal position, requiring the change into a vertical position within the mold. Moreover, holding must be tight in order to overcome a floating force from molten steel. Furthermore, the immersion nozzle 2 in a state of being set to the upper refractory (upper nozzle) must be closely coincident in the direction of its molten-steel delivery port 2*f* with a longer-side direction of the mold.

Namely, the immersion nozzle 2 must be in a structure to vary its position or be tightly griped so as to overcome a floating force due to molten metal when gripped by a jig. Furthermore, in the gripping structure, it is desired to give consideration for naturally determining a direction of the molten-steel ejecting port 2*f* of the immersion nozzle 2.

As one structure for the above, the immersion nozzle 2 is covered with the metal case 2*d* in a part from an upper end surface thereof to the lower part to the neck, wherein on a surface of the metal case 2*d* in the same side as the molten-steel delivery port 2*f*, projections 2*e* having a length in a circumferential direction of the metal case 2*d* of at least two-thirds of an inner bore diameter of the immersion nozzle 2 are horizontally and parallel provided at two points, i.e. in a position of at least 95 mm below the upper end surface of the immersion nozzle (dimension to a projection center) and a position spaced below at least 50 mm from that position. The position of projection 2*e* is determined from the restriction in space to the immersion nozzle exchanging apparatus or space for removal and insertion from and to the mold. It is preferred to grip the immersion nozzle 2 at a point around 120 mm from the upper end surface. In order to tightly hold the immersion nozzle 2 for freely changing the position thereof and overcome a molten-steel floating force to keep the position, the two projections 2*e* preferably has a spacing of 50 mm or greater in its center dimensions. The projections 2*e* can be used for positioning upon gripping the immersion nozzle 2 in a correctly set position by a handling jig such that the direction of its molten-steel delivery port 2*f* coincides with the direction of a longer side of the mold.

FIG. 14 to FIG. 18 shows an operating state that a closing fire plate is used to close the nozzle port of the upper nozzle thereby closing a cast operation.

When cast operation is ended or when cast must be suspended due to such a trouble that flow-rate control is difficult during casting or where the nozzle port of the upper nozzle 4 cannot be closed by a stopper brick, a closing fire plate 20 without molten-steel passing port is set up in place of a new immersion nozzle 2. By performing operation in the procedure similar to FIG. 5 to FIG. 9, the nozzle port of the upper nozzle 4 can be closed to stop molten steel from flowing out.

In the series of operations, the closing fire plate 20 has a thickness 12 mm greater than the thickness of the flange 2*b* of the immersion nozzle 2. When the closing fire plate 20 is pushed by the pusher 10*d* to begin riding onto the first key plate 7, despite in the spring body supporting seat surface 10*a* position where, during immersion nozzle exchange, the compression force of the spring body 8 corresponding to the key plate 7 is released, because the closing fire plate 20 is great in thickness, it takes a form to be urged onto the junction surface of the upper nozzle 4, further pressing down the key plate 7. Namely, it is moved in a state of compressing the spring body 8 and pressure-joined to the upper nozzle 4 thus being pushed into a predetermined position. By increasing the thickness of the closing fire plate 20, a sufficient urge force is secured for pushing out the immersion nozzle 2 and at the same time stopping molten steel from flowing out. Consequently, where using a closing fire plate 20, the nozzle port of the upper nozzle must be emergently closed. Differently from exchanging the immersion nozzle 2, it moves in a state of being urged onto the junction surface of the upper nozzle 4 during the movement. Furthermore, the urge force onto the junction surface gradually increases. When the closing fire plate 20 reaches a predetermined position, simultaneously a predetermined urge force 500 kg is applied. In setting and moving the closing fire plate 20, the upper-surface both ends thereof are chamfered at least over a width of 10 mm and a depth of 12 mm not to be prevented from moving by the plunger 30.

Figure 19:
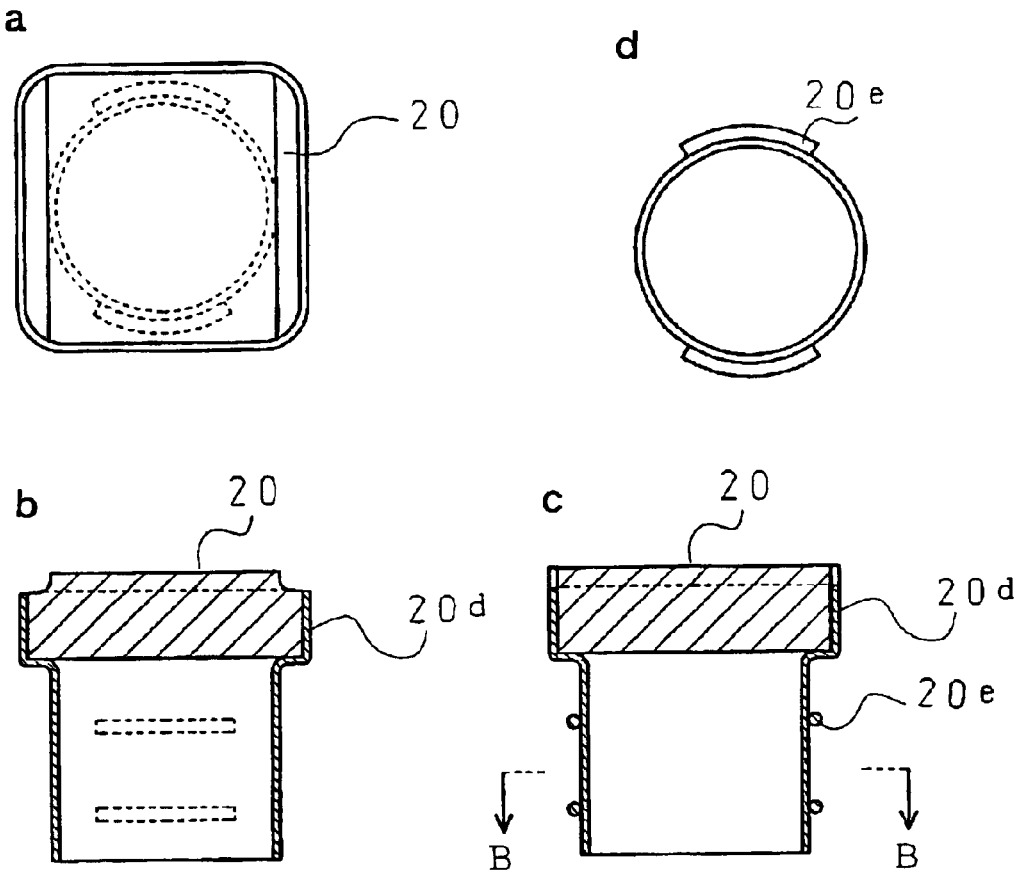
FIG. 19 shows a closing fire plate to be applied to the immersion nozzle exchanging apparatus of the invention, wherein the same figure a is a plan view, the same figure b and c are vertical sectional views, and the same figure d is a B—B sectional view of c.
Figure 20:
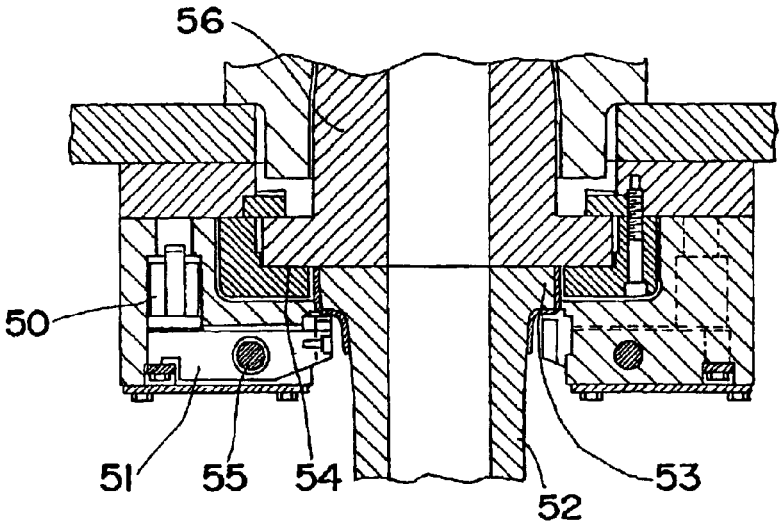
FIG. 20 shows a conventional example of an immersion nozzle exchanging apparatus.
Figure 20:
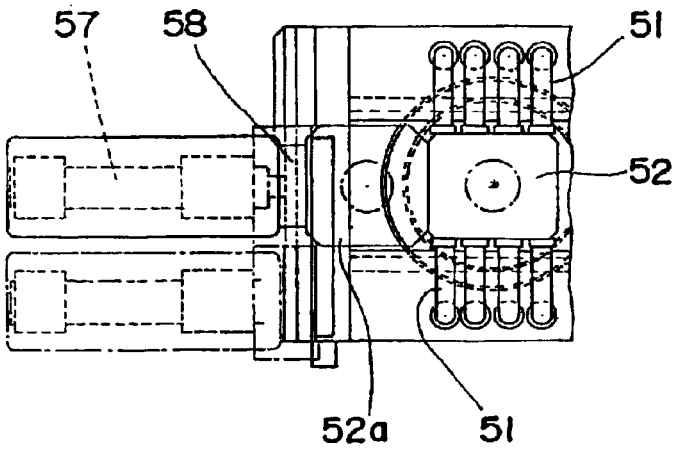
Figure 20:
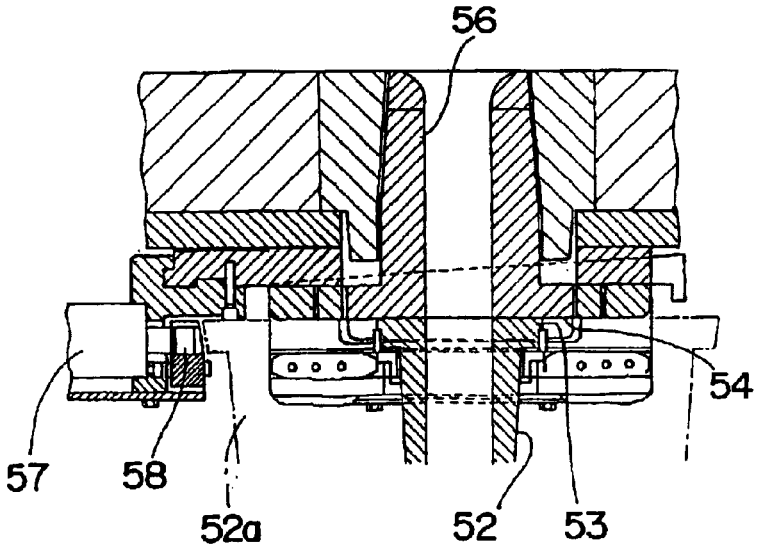

FIG. 19 shows a shape of the closing fire plate 20. Similarly to the immersion nozzle shown in FIG. 13, the neck is covered with a metal case 20*d* to have projections 20*e* on the outer peripheral surface of the metal case 20*d* in a part below the neck.

Although the features of the invention were explained on the basis of FIG. 1 to FIG. 19, the immersion nozzle exchanging apparatus of the invention, besides directly provided in the tundish bottom referred to FIG. 1, can be provided through a sliding nozzle device for controlling molten-steel flow rate. Furthermore, in applying the immersion nozzle of the invention to the immersion nozzle exchanging apparatus of the invention, it is possible to separately prepare an apparatus for handling the immersion nozzle.

As in the above, the present invention, in an immersion nozzle exchanging apparatus for swiftly exchanging an immersion nozzle during casting, can apply a seal member to the junction surface and cut the metal or the like deposited around the nozzle port. Furthermore, the immersion nozzle can be pressure-joined evenly to the entire junction surface in a state of keeping the immersion nozzle in its position thus conspicuously enhancing sealability in the junction surface and stabilizing steel quality. Moreover, the trouble during immersion-nozzle exchanging operation could be eliminated. Also, in an emergency, cast stop is possible using a closing fire plate, improving safety. Furthermore, by providing a grip projection on the immersion nozzle or closing fire plate, the handling using a jig became easy and positive.

INDUSTRIAL APPLICABILITY

The present invention is applicable to an immersion nozzle exchanging apparatus capable of securing high sealability in joint surface between the immersion nozzle and the upper refractory, and to an immersion nozzle and closing fire plate to be used thereon.

What is claimed is:

1. An immersion nozzle exchanging apparatus for removing a first nozzle and installing a second nozzle, wherein each nozzle having a long axis and a flange, and each flange having an underside, the apparatus comprising:

a plurality of key plates, said key plates having outside ends, said plates being disposed in parallel along respective opposite sides of said nozzle flange underside, said plates moving said first nozzle perpendicular to said first nozzle long axis to remove said first nozzle, said plates moving said second nozzle perpendicular to said second nozzle long axis to install said second nozzle;

a plurality of lower spring support shafts, said lower support shafts contacting respective outside ends of said key plates;

a plurality of upper spring support shafts, said upper support shafts having top ends, said upper support shafts communicating with said lower support shafts;

a spring body interposed between said lower and upper spring support shafts, said lower and upper spring support shafts communicating through said spring;

a slide frame, said slide frame contacting said top ends of said upper support shafts;

a pusher, said pusher being connected to said slide frame, said pusher communicating with said first nozzle and said key plates for removing said first nozzle;

a hydraulic cylinder, said cylinder being connected to said slide frame, said cylinder moving said slide frame perpendicular to said first nozzle long axis; and a spring-body supporting seat surface, said supporting seat surface being connected to said slide frame, said supporting seat surface contacting said upper support shafts, said supporting seat surface comprising two horizontal surfaces, said horizontal surfaces being different in length, and said supporting seat surface having a continuously extending taper surface.

2. The apparatus of claim 1, wherein said first and second nozzles have a junction surface and a concave surface for holding a seal member having a depth of 1.0–10 mm against said junction surface.

3. The apparatus of claim 1, wherein each flange of said nozzles has a thickness, said apparatus further comprising a closing fire plate, said plate having a thickness, said thickness being greater than said thickness of each flange of said nozzles by at least 12 mm.

4. The apparatus of claim 3, wherein each of said supporting seat surfaces has a long axis, said closing fire plate has an upper surface, said upper surface has opposing ends, said opposing ends being perpendicular to said long axis of said supporting seat surfaces, and said ends being recessed over at least a width of 10 mm and a depth of 12 mm.

5. The apparatus of claim 1, wherein said key plate performs the steps of urging said first nozzle perpendicular to said first nozzle long axis to remove said first nozzle and maintaining a position of said first nozzle along said first nozzle long axis.

* * * * *